US008776768B2

(12) United States Patent
Otsubo et al.

(10) Patent No.: US 8,776,768 B2
(45) Date of Patent: Jul. 15, 2014

(54) EXHAUST GAS RECIRCULATION APPARATUS

(75) Inventors: Makoto Otsubo, Anjo (JP); Fumiaki Aoki, Nishio (JP); Jun Yamada, Okazaki (JP); Tadashi Komiyama, Chiryu (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 1237 days.

(21) Appl. No.: 12/647,308

(22) Filed: Dec. 24, 2009

(65) Prior Publication Data

US 2010/0163006 A1 Jul. 1, 2010

(30) Foreign Application Priority Data

Dec. 26, 2008 (JP) ..... 2008-332519

(51) Int. Cl.
*F02B 47/08* (2006.01)
*F02M 25/07* (2006.01)

(52) U.S. Cl.
CPC ..... *F02M 25/0748* (2013.01); *F02M 25/0787* (2013.01)
USPC ..... 123/568.2; 123/568.11

(58) Field of Classification Search
CPC ..... F02M 25/0707; F02M 25/074; F02M 25/0747; F02M 25/0723; F02M 25/0722; F02M 35/10222; F02M 25/0724; F02M 25/0785; F02M 25/0792; F02M 25/0787; F02M 25/0772; F02M 25/0717; F02M 25/0754; F02M 25/0718; F02D 41/0077; F02D 41/0072; F02D 41/005; F02B 31/06; F02B 31/08; F02B 31/082; F02F 1/4214
USPC ..... 123/568.11, 568.17, 568.18, 568.19, 123/568.2, 568.25, 306, 307, 308, 309; 701/108; 60/278, 605.2
See application file for complete search history.

(56) References Cited

U.S. PATENT DOCUMENTS 3,820,514 A * 6/1974 Kuehl ..... 123/568.18
4,023,543 A * 5/1977 Ishikawa ..... 123/286
4,192,265 A * 3/1980 Amano et al. ..... 123/274
4,442,809 A * 4/1984 Nohira et al. ..... 123/316

(Continued)

FOREIGN PATENT DOCUMENTS

CA 1065704 11/1979
JP 52-170127 12/1977

(Continued)

OTHER PUBLICATIONS

Japanese Office Action dated Nov. 2, 2010, issued in corresponding Japanese Application No. 2008-332519, with English Translation.

*Primary Examiner* — Hai Huynh
*Assistant Examiner* — Raza Najmuddin
(74) *Attorney, Agent, or Firm* — Nixon & Vanderhye P.C.

(57) ABSTRACT

An EGR control device is provided in a branched-off pipe portion of a recirculation pipe unit. The EGR control valve is opened during an exhaust gas recirculation period, which is a part of a valve-opening period of an intake valve, so that exhaust gas is re-circulated into a combustion chamber during the exhaust gas recirculation period. As a result, swirl flow of the re-circulated exhaust gas to be formed in the combustion chamber is increased to improve ignitionability and to facilitate combustion of air-fuel mixture.

15 Claims, 11 Drawing Sheets

(56) References Cited

U.S. PATENT DOCUMENTS

| | | | | |
|---|---|---|---|---|
| 4,494,504 | A * | 1/1985 | Yagi et al. | 123/308 |
| 5,762,051 | A * | 6/1998 | Okamoto | 123/568.18 |
| 6,065,456 | A * | 5/2000 | Miyoshi et al. | 123/568.2 |
| 6,089,212 | A * | 7/2000 | Piock et al. | 123/568.17 |
| 6,230,696 | B1 * | 5/2001 | Veit et al. | 123/568.12 |
| 6,772,729 | B2 * | 8/2004 | Brosseau et al. | 123/308 |
| 2003/0010314 | A1 * | 1/2003 | Brosseau et al. | 123/306 |
| 2006/0283429 | A1 * | 12/2006 | Kuhnel et al. | 123/568.18 |
| 2013/0000614 | A1 * | 1/2013 | Freund et al. | 123/568.2 |

FOREIGN PATENT DOCUMENTS

| | | |
|---|---|---|
| JP | 61-014464 | 1/1986 |
| JP | 10-252486 | 9/1998 |
| JP | 2008-128180 | 6/2008 |
| JP | 2008-280943 | * 11/2008 |

* cited by examiner

EXHAUST GAS RECIRCULATION APPARATUS

CROSS REFERENCE TO RELATED APPLICATION

This application is based on Japanese Patent Application No. 2008-332519 filed on Dec. 26, 2008, the disclosure of which is incorporated herein by reference.

FIELD OF THE INVENTION

The present invention is applied to an internal combustion engine having combustion chambers, each of which is operatively communicated to an intake air passage opened/closed by an intake valve and to an exhaust gas passage opened/closed by an exhaust valve, and relates to an exhaust gas recirculation apparatus for re-circulating apart of exhaust gas (discharged from the combustion chambers) from the exhaust gas passage to the intake air passage.

BACKGROUND OF THE INVENTION

An exhaust gas recirculation system is known in the art, for example, as disclosed in Japanese Patent Publication No. H10-252486, according to which an exhaust port of one of combustion chambers is connected to an intake port of another combustion chamber, so that a part of exhaust gas from the one combustion chamber which is in an exhaust stroke is re-circulated into the other combustion chamber which is in an intake stroke.

According to the prior art having the above structure, flow speed of the exhaust gas swirling in the combustion chamber around a center axis thereof is increased (that is, the swirl of the exhaust gas is increased), because the exhaust gas from the combustion chamber of the exhaust stroke is injected into the combustion chamber of the intake stroke.

Since an exhaust gas purifying apparatus, a muffler, and other devices are generally provided in an exhaust pipe of an engine, pressure in the exhaust pipe between the combustion chambers and those devices is higher than pressure in an intake pipe of the engine. In the multi-cylinder engine, multiple exhaust ports connected to the combustion chambers are converged into the exhaust pipe. Therefore, even when one of the combustion chambers is not in the exhaust stroke, the other combustion chamber is in the exhaust stroke, so that the pressure in the exhaust pipe is always kept at high pressure.

As a result, in the case that one of the combustion chambers in the exhaust stroke is connected to the other combustion chamber in the intake stroke by respective recirculation pipes, the exhaust gas may be re-circulated from the exhaust port to the intake port through the recirculation pipe even during a period in which the other combustion chamber is in strokes other than the intake stroke.

When the exhaust gas is always re-circulated into the intake pipe (namely, re-circulated into the respective intake ports not only in the intake stroke but in the other strokes), amount of the exhaust gas in the intake pipe is increased. As a result, a ratio of intake air among gas to be introduced from the intake pipe into the combustion chamber during the intake stroke is relatively decreased. Ignitionability for the gas (mixture of the intake air, injected fuel, and the exhaust gas) will be adversely affected. Accordingly, it is unavoidable in the prior art to provide a control valve in the recirculation pipe for limiting amount of the exhaust gas to be re-circulated. When such a control valve is provided in the recirculation pipe, sufficient amount of the exhaust gas may not be re-circulated into the combustion chamber in the intake stroke, even in the case that the exhaust gas is forcibly re-circulated into the combustion chamber in the intake stroke by use of the high pressure in the exhaust port for the combustion chamber in the exhaust stroke. This is because the amount of the exhaust gas to be re-circulated through the recirculation pipe is limited by the control valve. As explained above, if large amount of the exhaust gas would be re-circulated into the combustion chamber in the intake stroke, the ignitionability may be deteriorated.

According to the above prior art, the sufficient amount of the exhaust gas could not be re-circulated into the combustion chambers in view of the ignitionability. Therefore, it is not possible to increase the swirl of the exhaust gas in the combustion chambers. It can not be expected in the prior art to facilitate combustion of air-fuel mixture by formation of the swirl of the re-circulated exhaust gas in the combustion chamber.

SUMMARY OF THE INVENTION

The present invention is made in view of the above problems. It is an object of the present invention to provide an exhaust gas recirculation system having an EGR apparatus, in which ignitability of air-fuel mixture is improved to facilitate combustion thereof.

According to a feature of the invention, an exhaust gas recirculation system is applied to an internal combustion engine having multiple cylinders.

The exhaust gas recirculation system has a recirculation pipe unit having a gas inlet port connected to an exhaust gas passage of the engine. The recirculation pipe unit further has multiple branched-off pipe portions, each one end of the branched-off pipe portions being communicated to the gas inlet port and each other end of the branched-off pipe portions being respectively connected to each injection port opening to each of intake ports of the engine, so that exhaust gas injected into the respective intake ports flows into respective combustion chambers and flows along an inner wall of the corresponding combustion chamber so as to for swirl flow therein.

The exhaust gas recirculation system has multiple EGR control devices respectively provided in each of the branched-off pipe portions.

In the above exhaust gas recirculation system, each of the EGR control devices opens each of the corresponding branched-off pipe portions during an exhaust gas recirculation period which is a part of a valve-opening period of a corresponding intake valve, so that exhaust gas is re-circulated from the exhaust gas passage into the respective combustion chambers for which the corresponding intake valve is opened. And each of the EGR control devices closes the corresponding branched-off pipe portions at least during a valve closing period of the corresponding intake valve.

The exhaust gas re-circulating through the recirculation pipe unit is introduced into the combustion chamber during the exhaust gas recirculation period, which is controlled by the EGR control device. The exhaust gas introduced into the combustion chamber flows along an inner wall thereof to swirl around a center axis of the combustion chamber. Swirling movement is given, by the exhaust gas flow, to intake air introduced into the combustion chamber through the intake port, so that the intake air also swirls in the combustion chamber. Since the exhaust gas flows along the inner wall of the combustion chamber, density of the exhaust gas in the vicinity to the center axis of the combustion chamber is smaller than that in the vicinity to the inner wall. Ignitionability for the air-fuel mixture is thereby improved for the engine, in which a spark plug is provided in the vicinity to the center axis of the combustion chamber.

According to the above feature, since the branched-off pipe portion of the recirculation unit is closed by the EGR control device at least during the valve closing period of the intake valve, amount of the exhaust gas injected into the intake port for a unit time is increased. As a result, swirling speed of the exhaust gas in the combustion chamber is increased to facilitate the combustion of the air-fuel mixture.

As above, according to the invention, the ignitionability is improved to facilitate the combustion of the air-fuel mixture.

In the valve opening period of the intake valve, there are an air-intake period during which operating gas such as the intake air in the intake port flows into the combustion chamber and a blow-back period during which a part of the operating gas introduced into the combustion chamber blows back to the intake port. It is known in the art that those air-intake period and blow-back period may change depending on opening and closing timings of the intake valve.

According to another feature of the invention, the exhaust gas recirculation period is apart of an air-intake period starting from a point at which flow-in of intake air to the combustion chamber starts and ending at a point at which the flow-in of the intake air to the combustion chamber ends, and the EGR control devices closes the corresponding branched-off pipe portion during a period other than the air-intake period.

According to the above feature, since the branched-off pipe portion of the recirculation pipe unit is opened only for the exhaust gas recirculation period, which is within the air-intake period, the exhaust gas injected into the intake port may not remain in the intake port but immediately and surely introduced into the combustion chamber.

According to a further feature of the invention, the EGR control devices opens the corresponding branched-off pipe portion only during the exhaust gas recirculation period, so that the corresponding branched-off pipe portion is closed during a period other than the exhaust gas recirculation period.

According to a further feature of the invention, a blow-back period is not included in the exhaust gas recirculation period, so that the branched-off pipe portion is closed by the corresponding EGR control device during the blow-back period.

According to a further feature of the invention, each of the EGR control devices is composed of an electromagnetic valve operated with electrical power supply, and the exhaust gas recirculation system further comprises an electronic control unit for controlling opening and closing operation of the electromagnetic valve.

According to such feature, since the EGR control device is electronically operated to open and close the branched-off pipe, the exhaust gas can be re-circulated into the intake port at most appropriate timings.

The air-intake period for the combustion chamber can be measured by detecting change of air flow in the intake port in the vicinity of the combustion chamber. It is, however, difficult to provide a device for detecting the change of the air flow at a position close to the combustion chamber.

According to a still further feature of the invention, the electronic control unit has a valve-opening period detecting portion for detecting the valve-opening period of the corresponding intake valve, and an estimating portion for estimating the air-intake period based on the valve-opening period, wherein the electronic control unit controls the opening and closing operation of the electromagnetic valve based on such estimated air-intake period.

As explained above, it is known in the art that the air-intake period changes depending on the opening and closing timings of the intake valve. According to the invention, the air-intake period is estimated based on information relating to the opening and closing timings of the intake valve. As a result, it is possible to easily obtain the air-intake period, without providing the device for detecting the change of the air flow at the position close to the combustion chamber.

According to a still further feature of the invention, the electronic control unit has a valve-opening period detecting portion for detecting the valve-opening period of the corresponding intake valve, a rotational speed detecting portion for detecting rotational speed of a crank shaft of the engine, and an estimating portion for estimating the air-intake period based on the valve-opening period and the rotational speed of the crank shaft. Then, the electronic control unit controls the opening and closing operation of the electromagnetic valve based on such estimated air-intake period.

When the rotational speed of the crank shaft is changed, speed of volume-change of the combustion chamber during the intake stroke is correspondingly changed. Then, the flow speeds of the intake air, the injected fuel, and the re-circulated exhaust gas, which flow through the intake port, are also changed. Since the operating gas (such as, the intake air, the injected atomized fuel and the exhaust gas) has a mass to some extent, inertia force of the operating gas is changed when the flow speed of the operating gas is changed. As a result, the blow-back period is changed.

According to the invention, however, the estimating portion estimates the air-intake period based on the rotational speed of the crank shaft in addition to the information relating to the valve-opening period (the valve opening and closing timings) of the intake valve, so that estimation accuracy for the air-intake period can be further improved.

According to a still further feature of the invention, the electronic control unit has a valve-opening period detecting portion for detecting the valve-opening period of the corresponding intake valve, a throttle opening detecting portion for detecting throttle opening degree of a throttle valve of the engine, and an estimating portion for estimating the air-intake period based on the valve-opening period and the throttle opening degree of the throttle valve. Then, the electronic control unit controls the opening and closing operation of the electromagnetic valve based on such estimated air-intake period.

In the engine having a throttle valve device, amount of intake air flowing through an intake air passage is changed depending on the throttle opening degree of the throttle valve. As explained above, when the flow amount of the intake air (one of the operating gas) is changed, the inertia force of the operating gas is changed. As a result, the blow-back period is changed.

According to the invention, however, the estimating portion estimates the air-intake period based on the throttle opening degree of the throttle valve in addition to the information relating to the valve-opening period (the valve opening and closing timings) of the intake valve, so that estimation accuracy for the air-intake period can be further improved.

According to a still further feature of the invention, the electronic control unit has a valve-opening period detecting portion for detecting the valve-opening period of the corresponding intake valve, a rotational speed detecting portion for detecting rotational speed of a crank shaft of the engine, a throttle opening detecting portion for detecting throttle opening degree of a throttle valve of the engine, and an estimating portion for estimating the air-intake period based on the valve-opening period, the rotational speed of the crank shaft, and the throttle opening degree of the throttle valve. Then, the electronic control unit controls the opening and closing operation of the electromagnetic valve based on such estimated air-intake period.

According to the invention, however, the estimating portion estimates the air-intake period based on not only the rotational speed of the crank shaft but also the throttle opening degree of the throttle valve, both of which have influences on the inertia force of the operating gas (such as the intake air, etc), in addition to the information relating to the valve-opening period (the valve opening and closing timings) of the intake valve. Therefore, the estimation accuracy for the air-intake period can be further improved.

According to a still further feature of the invention, the valve-opening period detecting portion detects the valve-opening period of the corresponding intake valve, based on a crank angle of a crank shaft and a cam shaft angle of a cam shaft of the engine.

According to the above feature, it is possible to easily detect the valve-opening period, that is, the valve opening and closing timings of the intake valve based on the rotational phase-difference between the crank angle of the crank shaft and the cam shaft angle of the cam shaft of the engine.

In the engine in which an air control valve is provided in the intake air passage for controlling amount of the intake air or controlling air-flow of the intake air in the combustion chamber, differential pressure is generated between an upstream side and a downstream side of the air control valve during a period in which the intake air is introduced into the combustion chamber.

According to a still further feature of the invention, the exhaust gas recirculation system has;

a differential pressure detecting device for detecting differential pressure, which is a difference between pressure at an upstream side and a downstream side of an air control valve provided in each of intake air passages of the engine respectively connected to the intake ports, wherein the air control valve is composed of a throttle valve for controlling amount of intake air to be supplied into the combustion chamber, or composed of an air-flow control valve for controlling air-flow of the intake air to be supplied into the combustion chamber; and an electronic control unit having an estimating portion for estimating the air-intake period based on the differential pressure.

Then, the electronic control unit controls the opening and closing operation of the EGR control devices based on such estimated air-intake period.

According to the above feature, since the differential pressure detecting device is provided for detecting the differential pressure between the upstream side and the downstream side of the valve, the estimation accuracy for the air-intake period can be further improved.

According to a still further feature of the invention, each of the electromagnetic valves of the EGR control devices is operated by ON-OFF control of the electric power supply, and a duty ratio of the ON-OFF control is controlled by the electronic control unit.

According to the above feature, it is possible to freely change the recirculation amount of the exhaust gas flowing through the EGR control device by changing the duty ratio for the EGR control valve. As a result, it is possible to precisely control the recirculation timing as well as the recirculation amount of the exhaust gas by means of the EGR control device.

According to a still further feature of the invention, each of the EGR control devices is a mechanically operated valve device, which opens and closes the corresponding branched-off pipe portion in accordance with differential pressure, which is a difference between pressure at an upstream side and a downstream side of an air control valve provided in each of intake air passages of the engine respectively connected to the intake ports, and the air control valve is composed of a throttle valve for controlling amount of intake air to be supplied into the combustion chamber, or composed of an air-flow control valve for controlling air-flow of the intake air to be supplied into the combustion chamber.

According to the above feature, since the mechanically operated valve device is operated by the differential pressure between the upstream side and the downstream side of the air control valve so that the recirculation passage is opened by the differential pressure during the air-intake period, the recirculation passage is automatically opened by the differential pressure generated in the air-intake period. Therefore, it is not necessary to estimate the air-intake period based on detection signals from various kinds of sensors, and thereby the exhaust gas recirculation system becomes simpler.

According to a still further feature of the invention, the mechanically operated valve device comprises; a housing body having an accommodating portion for movably accommodating a valve member; and first and second pressure chambers formed in the housing body at opposite sides of the valve member.

In such mechanically operated valve device, the first pressure chamber is connected to an upstream side of the air control valve so that the pressure in the branched-off pipe portion at the upstream side of the air control valve is introduced into the first pressure chamber, and the second pressure chamber is connected to a downstream side of the air control valve so that the pressure in the branched-off pipe portion at the downstream side of the air control valve is introduced into the second pressure chamber.

According to the above feature, since the pressures at the upstream side and the downstream side of the air control valve are respectively introduced into the first and second pressure chambers formed in the housing body at opposite sides of the valve member, the recirculation passage is automatically opened by the differential pressure generated in the air-intake period.

According to a still further feature of the invention, a flow-amount control valve is provided in the recirculation pipe unit so as to control flow-amount of the exhaust gas to be recirculated through the recirculation pipe unit.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

Figure 1:
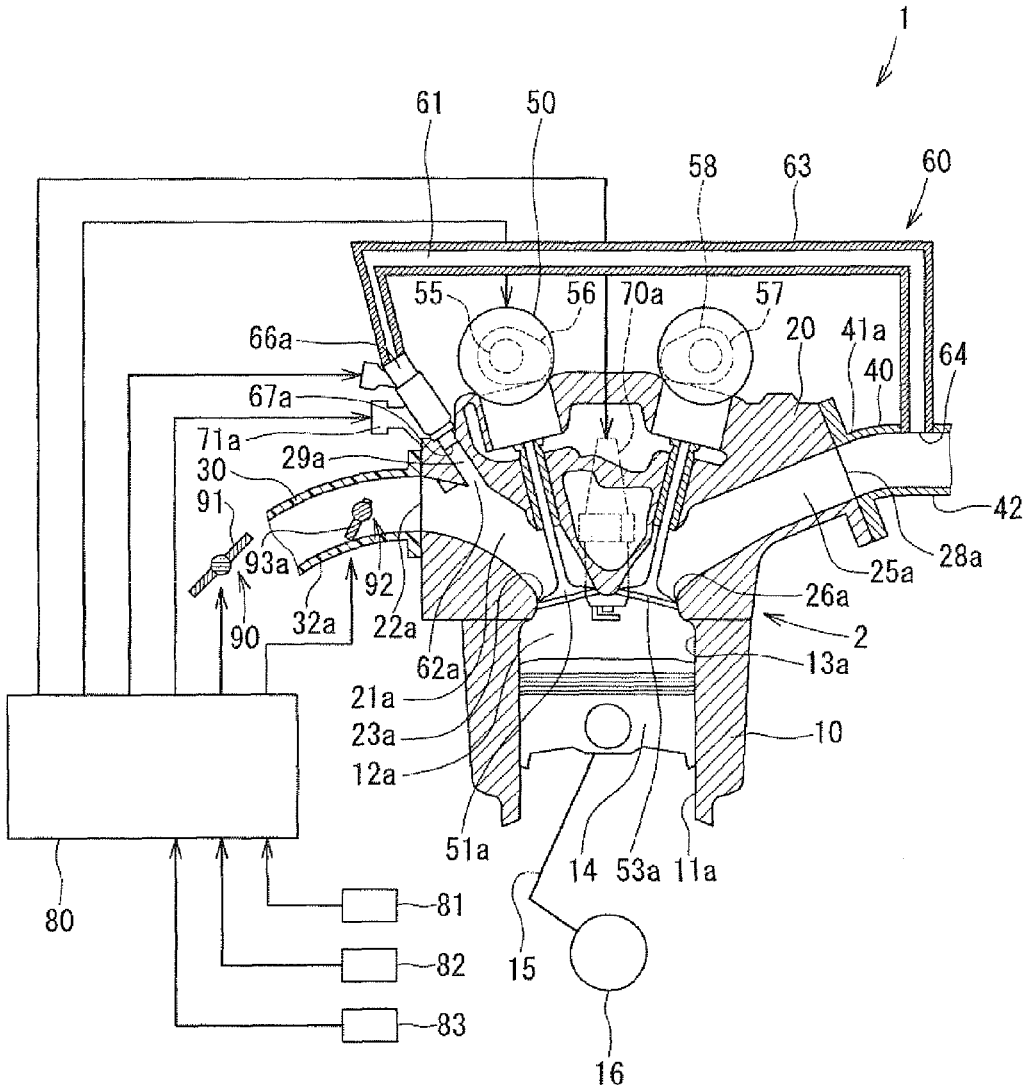
FIG. 1 is a cross-sectional view schematically showing a structure of an engine, to which an exhaust gas recirculation apparatus (EGR apparatus) according to a first embodiment of the present invention is applied.

Embodiments of the present invention will be hereinafter explained with reference to the drawings. The same reference numerals are used through multiple embodiments for such components or portions, which are identical or similar to each other, so that overlapped explanation may be omitted.

First Embodiment

Figure 2:
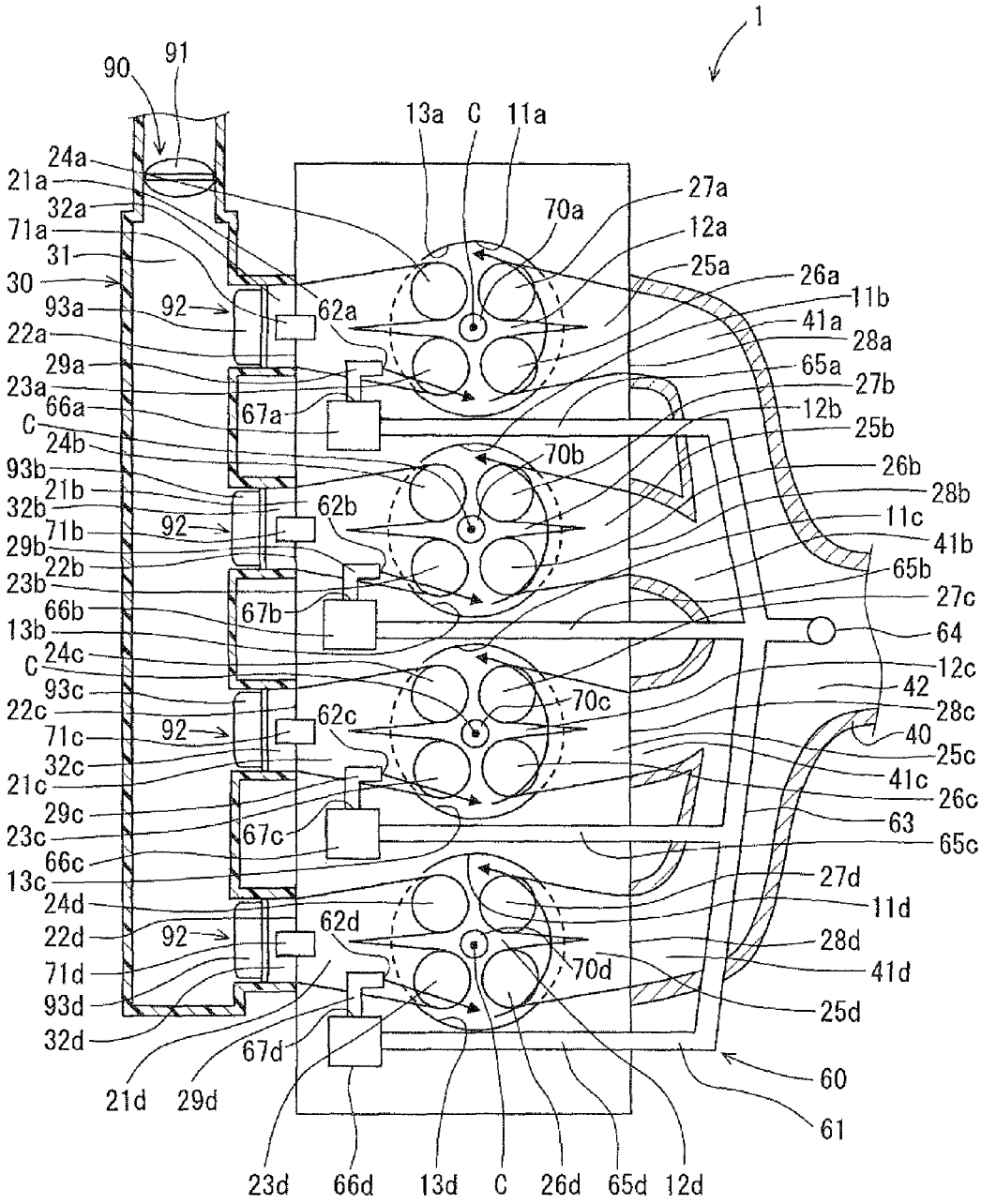
FIG. 2 is a schematic view showing the structure of the engine shown in FIG. 1, when viewed from a side of a cylinder head thereof.

A first embodiment of the present invention will be explained with reference to the drawings. FIG. 1 is a cross-sectional view schematically showing a structure of an internal combustion engine 1 (hereinafter, simply referred to as an engine), to which an exhaust gas recirculation apparatus 60 according to the first embodiment of the present invention is applied. The engine 1 is a four-stroke, four-cylinder and in-line type gasoline engine. In FIG. 1, only the first cylinder #1 (among first to fourth cylinders #1 to 44) is shown. FIG. 2 is a schematic view showing the structure of the engine 1 shown in FIG. 1, when viewed from a side of a cylinder head 20 thereof.

The engine 1 has an engine main structure 2 and an electronic control unit (ECU) 80 for controlling the engine main structure 2.

The engine main structure 2 is composed of a cylinder block 10, the cylinder head 20, an intake manifold 30, an exhaust manifold 40, the exhaust gas recirculation apparatus 60 (hereinafter, also referred to as an EGR apparatus), and so on.

The cylinder block 10 has four cylinder bores lie to 11*d*. In this specification, each of suffixes a to d, which is suffixed to respective reference numerals, respectively corresponds to the first to fourth cylinders #1 to #4.

An upper side of each cylinder bores 11*a* to lid is opened. The cylinder head 20 is fixed to an upper side of the cylinder block 10 by fixing means, such as bolts (not shown), so as to close the opened ends of the cylinder bores 11*a* to 11*d*. Each of combustion chambers 12*a* to 12*d* corresponding to the first to fourth cylinders 41 to #4 is respectively formed by each of the cylinder bores 11*a* to 11*d*, a piston 14 and the cylinder head 20.

The piston 14 is provided in each of the combustion chambers 12*a* to 12*d*, so that the piston 14 reciprocates along a center axis C of the respective combustion chambers 12*a* to 12*d*, wherein the piston 14 is in sliding contact with an inner wall 13*a* to 13*d* of the respective cylinder bores 11*a* to 11*d*. The piston 14 is reciprocated in the respective cylinder bores 11*a* to 11*d*, upon receiving energy generated when fuel supplied into the respective combustion chambers 12*a* to 12*d* is combusted. Reciprocal movement of the piston 14 is transmitted to a crank shaft 16 via a connecting rod 15. The crank shaft 16 converts the reciprocal movement of the piston 14 into rotational movement so as to output such rotational movement to an outside of the engine.

The cylinder head 20 has intake ports 21*a* to 21*d* for supplying operating gas (which is composed of intake air, fuel, and exhaust gas for EGR) into the combustion chambers 12*a* to 12*d*, and exhaust ports 25*a* to 25*d* for discharging combustion gas (which is combusted in the combustion chambers 12*a* to 12*d*) to the outside of the engine as exhaust gas.

The intake port 21*a* is branched off into two air flow passages and has an open end 22*a* at an upstream side of the air flow passages, so that the open end 22*a* is connected to the intake manifold 30. The intake port 21*a* has two open ends 23*a* and 24*a* at a downstream side of the respective air flow passages, so that the open ends 23*a* and 24*a* are operatively communicated to the combustion chamber 12*a*. The other intake ports 21*b* to 21*d* likewise have open ends 22*b* to 22*d* at the upstream sides thereof and open ends 23*b* to 23*d* and 24*b* to 24*d* at the respective downstream sides thereof. Intake valves 51*a* to 51*d* are respectively provided at the cylinder head 20, so as to open and close the open ends 23*a* to 23*d* and 24*a* to 24*d* of the respective intake ports 21*a* to 21*d*.

Each of the intake valves 51*a* to 51*d* is driven by a cam 56 fixed to a cam shaft 55, which is rotated in conjunction with the crank shaft 16, so that the intake valves 51*a* to 51*d* open and close the open ends 23*a* to 23*d* and 24*a* to 24*d* of the respective intake ports 21*a* to 21*d*.

A valve timing control device 50 is provided at the cylinder head 20 in order to advance or retard an opening and/or closing timing of the intake valves 51*a* to 51*d* with respect to a rotational angle of the crank shaft 16.

The exhaust port 25*a* is formed in such a manner that two gas flow passages are collected into one gas flow passage. Therefore, the exhaust port 25*a* has two open ends 26*a* and 27*a* at upstream sides of the gas flow passages, which are operatively communicated to the combustion chamber 12*a*, and has an open end 28*a* at a downstream side of the gas flow passage, which is connected to the exhaust manifold 40. The other exhaust ports 25*b* to 25*d* likewise have open ends 26*b* to 26*d* and 27*b* to 27*d* at the upstream sides thereof and open ends 28*b* to 28*d* at the respective downstream sides thereof. Exhaust valves 53*a* to 53*d* are respectively provided at the cylinder head 20, so as to open and close the open ends 26*a* to 26*d* and 27*a* to 27*d* of the respective exhaust ports 25*a* to 25*d*.

Each of the exhaust valves 53*a* to 53*d* is driven by a cam 58 fixed to a cam shaft 57, which is rotated in conjunction with the crank shaft 16, so that the exhaust valves 53*a* to 53*d* open and close the open ends 26*a* to 26*d* and 247 to 27*d* of the respective exhaust ports 25*a* to 25*d*.

Spark plugs 70*a* to 70*d* are provided at the cylinder head 20, so that each of igniting portions is exposed to the respective combustion chambers 12*a* to 12*d*. Each of the igniting portions of the spark plugs 70*a* to 70*d* is arranged at a position close to the center axis C of the respective combustion chambers 12*a* to 12*d*. The spark plugs 70*a* to 70 ignite the operating gas supplied into the respective combustion chambers 12*a* to 12*d* by generating sparks at the igniting portions.

Fuel injectors 71*a* to 71*d* are provided at the cylinder head 20, so that each of injecting portions is exposed into the respective intake ports 21*a* to 21*d* in order to inject fuel towards the respective combustion chambers 12*a* to 12*d*. The fuel injectors 71*a* to 71*d* may be provided in the cylinder head 20 in such a manner that each of the injecting portions is exposed to the respective combustion chambers 12*a* to 12*d*, in order to directly inject the fuel into the combustion chambers 12*a* to 12*d*.

The intake manifold 30 is fixed to the cylinder head 20 to supply the intake air into the respective intake ports 21*a* to 21*d*. The intake manifold 30 has a surge tank 31 into which the intake air having passed through an air-cleaner (not shown) is supplied, and bifurcating portions 32*a* to 32*d* to be respectively connected to the intake ports 21*a* to 21*d*. A throttle valve device 90 is provided at an upstream side of the surge tank 31 for controlling intake air amount to be supplied into the respective combustion chambers 12*a* to 12*d*.

The throttle valve device 90 has a throttle valve 91 for changing a cross-sectional area of the intake-air passage and a driving portion (not shown) for driving the throttle valve 91 to rotate. In a condition that the cross-sectional area of the intake-air passage (connected to the surge tank 31) is being controlled by the throttle valve 91, at least one of intake valves 51*a* to 51*d* opens the corresponding intake ports 21*a* to 21*d*, so that the intake air as well as injected fuel (atomized fuel) is introduced into the corresponding combustion chambers 12*a* to 12*d*. As a result, a pressure difference appears between an upstream side and a downstream side of the throttle valve 91. In such an operating period, pressure at the downstream side of the throttle valve 91 becomes lower than that at the upstream side.

Air-flow control devices 92 are provided at the respective bifurcating portions 32*a* to 32*d*. Each of the air-flow control devices 92 changes flow of the intake air flowing through the bifurcating portions 32*a* to 32*d*, so as to generate tumble flow in a longitudinal direction (the center axis C) of the combustion chamber when the intake air is introduced into the combustion chambers 12*a* to 12*d*.

Each of the air-flow control devices 92 has an air-flow control valve 93*a* (to 93*d*) for closing a part of the intake-air passage of the bifurcating portion 32*a* (to 32*d*) and a driving portion (not shown) for driving the air-flow control valve 93*a* (to 93*d*). In a condition that the air-flow control valve 93*a* (to 93*d*) is operated to close the part of the intake-air passage of the bifurcating portion 32*a* (to 32*d*), at least one of the intake valves 51*a* to 51*d* opens the corresponding intake ports 21*a* to 21*d*, so that the intake air as well as injected fuel (atomized fuel) is introduced into the corresponding combustion chambers 12*a* to 12*d*. As a result, a pressure difference appears between an upstream side and a downstream side of the respective air-flow control valves 93*a* to 93*d*. In such an operating period, pressure at each downstream side of the air-flow control valve 93*a* to 93*d* becomes lower than that at each upstream side.

The intake ports 21*a* to 21*d* and the intake manifold 30 are also referred to as the intake-air passage, and the throttle valve device 90 and the air-flow control devices 92 are also referred to as an air control valve.

The exhaust manifold 40 fixed to the cylinder head 20 for guiding exhaust gas discharged from the respective exhaust ports 25*a* to 25*d* to an exhaust gas purifying device (not shown), which is provided in an exhaust pipe connected at a downstream side of the exhaust manifold 40. The exhaust manifold 40 has bifurcating portions 41*a* to 41*d* respectively connected to the exhaust ports 25*a* to 25*d*, and a collecting portion 42 into which the bifurcating portions 41*a* to 41*d* are collected. The exhaust ports 25*a* to 25*d* and the exhaust manifold 40 are also referred to as an exhaust gas passage.

The exhaust gas recirculation apparatus 60 re-circulates a part of the exhaust gas discharged from the combustion chambers into the exhaust ports 25*a* to 25*d* back into the intake ports 21*a* to 21*d* as EGR gas. The exhaust gas recirculation apparatus 60 is composed of recirculation passages 61 for guiding the exhaust gas to the intake ports 21*a* to 21*d*, injection ports 62*a* to 62*d* connected to the recirculation passages 61 and injecting the EGR gas towards the respective intake ports 21*a* to 21*d*, and EGR control valves 66*a* to 66*d* for opening and closing the respective recirculation passages 61 at predetermined timings.

According to the present embodiment, each of the recirculation passages 61 is formed by an EGR pipe 63 and an injection passage 29*a* (to 29*d*) formed in the cylinder head 20 and communicated to the respective intake ports 21*a* to 21*d*. The injection ports 62*a* to 62*d* correspond to open ends of the respective injection passages 29*a* to 29*d* formed in the cylinder head 20.

The EGR pipe 63 has a common gas inlet port 64 connected to the exhaust manifold 40 and branched-off pipe portions 65*a* to 65*d*, which are branched off from the gas inlet port 64 and connected to the respective EGR control valves 66*a* to 66*d* for distributing the exhaust gas from the gas inlet port 64 into the respective EGR control valves 66*a* to 66*d*. The EGR pipe 63 forms apart of the recirculation passage inside thereof. Each of the injection ports 62*a* to 62*d* is directed toward each one of the open ends 23*a* to 23*d* and 24*a* to 24*d* for the respective intake ports 21*a* to 21*d*.

Each of the EGR control valves 66*a* to 66*d* is arranged between the respective branched-off pipe portions 65*a* to 65*d* and the respective injection passages 29*a* to 29*d*. Each of the EGR control valves 66*a* to 66*d* has an injecting portion 67*a* (to 67*d*). Each of the injecting portions 67*a* to 67*d* is arranged in the respective injection passages 29*a* to 29*d*.

Each of the EGR control valves 66*a* to 66*d* has a valve body (not shown) for opening and closing the recirculation passage 61, and a driving portion (not shown) for driving the valve body upon receiving electric power. The driving portion has an electromagnetic actuator for generating electromagnetic force when electric power is supplied thereto. The valve body is formed of magnetic material and moved in a valve opening direction (or in a valve closing direction) by the electromagnetic force generated at the driving portion so as to open and/or close the recirculation passage 61. The driving portion is operated by the electronic control unit (ECU) 80 explained below.

The EGR control valves 66*a* to 66*d* inject the EGR gas, which is supplied from the EGR pipe 63, through the injecting portions 67*a* to 67*d*. The EGR gas injected from the injecting portions 67*a* to 67*d* flows into the respective combustion chambers 12*a* to 12*d* through the injection passages 29*a* to 29*d*, the injection ports 62*a* to 62*d* and the open ends 23*a* to 23*d*.

The EGR gas supplied into the respective combustion chambers 12*a* to 12*d* flows along the inner wall 13*a* (to 13*d*), so that the EGR gas swirls around the center axis C. The intake air supplied into the combustion chamber 12*a* (to 12*d*) likewise swirls around the center axis C, because the intake air is dragged by the swirling EGR gas.

The EGR pipe 63 and the cylinder head 20 are also referred to as an EGR passage. The EGR control valves 66*a* to 66*d* and the ECU 80 are also referred to as an opening/closing device.

The EGR control valves 66*a* to 66*d* are also referred to as opening/closing valves. And the ECU 80 is also referred to as a control unit.

The ECU 80 controls operations of the fuel injectors 71*a* to 71*d*, the valve timing control device 50, the throttle valve device 90, the air-flow control devices 92, the spark plugs 70*a* to 70*d*, the EGR apparatus 60, and so on. The ECU 80 is composed of a microcomputer having CPU, ROM, RAM, and so on, and driving circuits.

As shown in FIG. 1, various kinds of sensors, such as a crank position sensor 81 for detecting rotational speed and crank angle of the crank shaft 16, a cam position sensor 82 for detecting cam shaft angle of the cam shaft 55, a throttle position sensor 83 for detecting opening degree of the throttle valve 91, and so on, are connected to the ECU 80. The ECU 80 has an input circuit for receiving signals from the above various kinds of sensors. The ECU 80 further has an output circuit for outputting driving signals to the fuel injectors 71*a* to 71*d*, the valve timing control device 50, the throttle valve device 90, the air-flow control devices 92, the spark plugs 70*a* to 70*d*, and the EGR apparatus 60, wherein the respective driving signals correspond to each command signal calculated by the micro-computer in accordance with program stored in a memory device, such as ROM and so on.

The ECU 80 controls operation of the engine 1 based on operational condition of the vehicle. For example, the ECU 80 calculates a target engine torque based on torque demand from a vehicle driver, load condition of the engine 1, and so on. Then, the ECU 80 controls fuel injection amounts to be injected by the fuel injectors 71*a* to 71*d* for the respective cylinders #1 to #4, fuel injection timings, opening/closing timings for intake valves 51*a* to 51*d* to be operated by the valve timing control device 50, the throttle opening degree of the throttle valve 91 to be driven by the throttle valve device 90, operation of the air-flow control valves 93*a* to 93*d* to be driven by the air-flow control device 92, the ignition timings for the spark plugs 70*a* to 70*d*, EGR gas amount to be operated by the EGR apparatus 60, and supply timing of the EGR gas, so that engine torque corresponding to the target engine torque may be outputted from the crank shaft 16.

According to the present embodiment, the ECU 80 controls the above devices and/or components 50, 60, 70*a* to 70*d*, 71*a* to 71*d*, 90 and 92, so that expansion stroke may be carried out in the respective cylinders #1 to #4, namely in the order of the first cylinder #1, the third cylinder #3, the fourth cylinder #4 and the second cylinder #2.

Now, an operation of the EGR apparatus 60, in particular, an operation of the EGR control valves 66*a* to 66*d* will be explained. The ECU 80 controls the EGR apparatus 60. As already explained, the EGR apparatus 60 is composed of the EGR pipe 63 and the EGR control valves 66*a* to 66*d* and so on.

Each of the EGR control valves 66*a* to 66*d*, as is also explained above, has the valve body and the electromagnetic driving portion. Electric power supply to the electromagnetic driving portion is controlled by the ECU 80. More exactly, the EGR control valves 66*a* to 66*d* are repeatedly and alternately opened and closed by the ECU 80, so long as the EGR control valves 66*a* to 66*d* are operated. A ratio of a valve opening time period to a total time period (which is a sum of the valve opening time period and valve closing time period) is controlled so as to control the EGR gas amount. The ECU 80 varies a duty ratio, which is a ratio of power supply period to a total time period (which is a sum of the power supply period and a power non-supply period), in order to control the ratio of the valve opening time period. When the duty ratio comes closer to 0%, the ratio of the valve opening time period becomes smaller so that the EGR gas amount becomes smaller. On the other hand, when the duty ratio comes closer to 100%, the ratio of the valve opening time period becomes larger, so that the EGR gas amount becomes larger.

As above, the ECU 80 controls the duty ratio for the EGR control valves 66*a* to 66*d*, in order to control supply timing of the EGR gas and the EGR gas amount.

Figure 3:
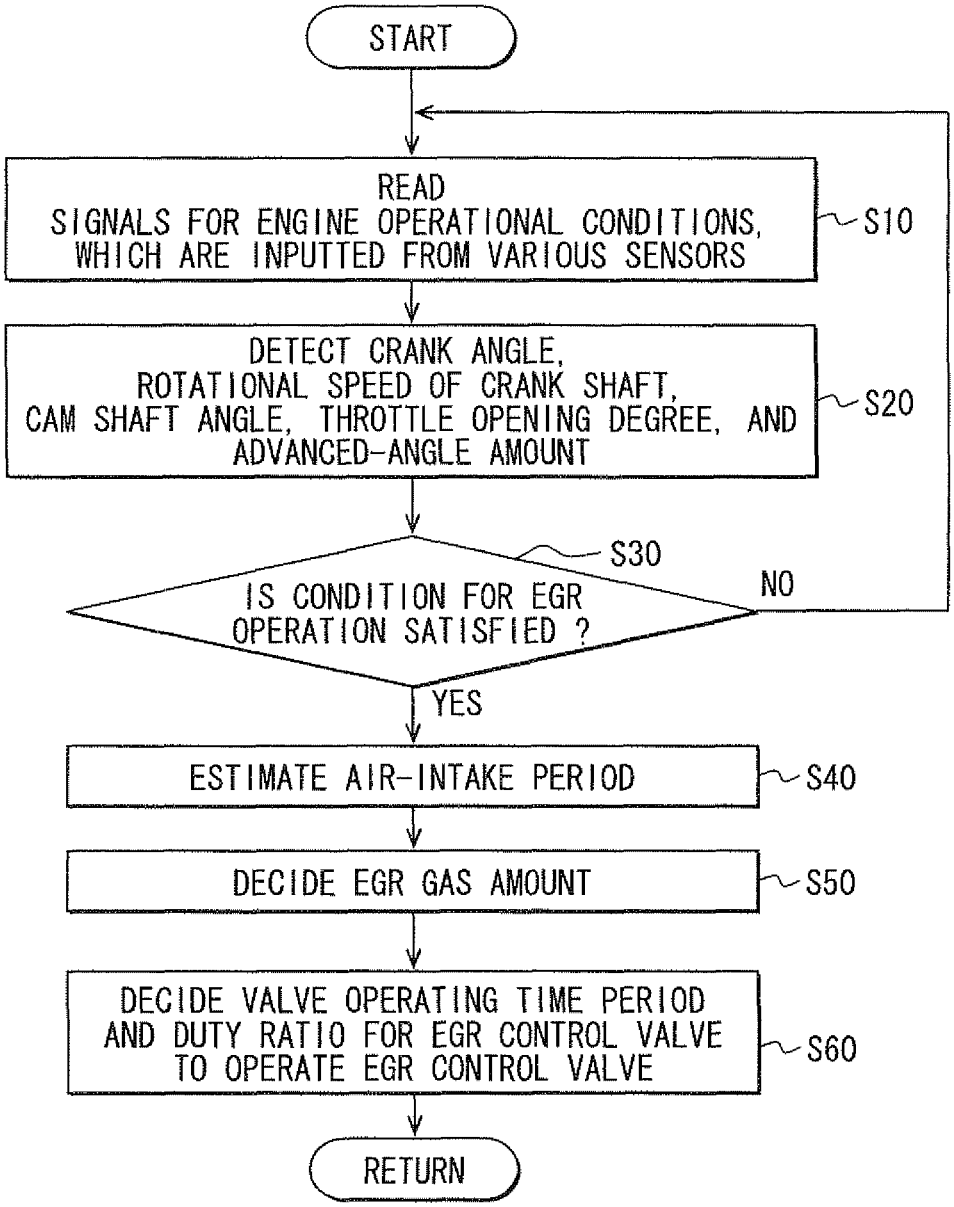
FIG. 3 is a flow-chart showing a control process of the EGR apparatus.

An operation (control) of the EGR apparatus 60 will be explained. FIG. 3 is a flow-chart showing a control process of the EGR apparatus 60.

At a step S10, the ECU 80 reads signals related to engine operational conditions, such as a crank position signal of the crank shaft 16 which is inputted to the ECU 80 from the crank position sensor 81, a cam shaft position signal of the cam shaft 55 which is inputted to the ECU 80 from the cam position sensor 82, a throttle position signal of the throttle valve 91 which is inputted to the ECU 80 from the throttle position sensor 83, and so on.

At a step S20, based on the above inputted signals for the engine operational conditions, the ECU 80 detects the engine operational conditions, such as the crank angle and rotational speed of the crank shaft 16, the throttle opening degree of the throttle valve 91, the cam shaft angle of the cam shaft 55, an advanced-angle amount which is a rotational phase difference of the cam shaft angle with respect to the crank angle, and so on. The process of the step S20 is also referred to as a valve-opening period detecting portion, a rotational speed detecting portion, and a throttle opening detecting portion.

At a step S30, the ECU 80 determines whether a condition for operating the EGR apparatus 60 is satisfied or not. According to the present embodiment, the determination at the step S30 is carried out based on the engine load condition. Namely, the ECU 80 determines that the condition for operating the EGR apparatus 60 is satisfied when the engine load condition is low or middle. On the other hand, the ECU 80 determines that the condition for operating the EGR apparatus 60 is not satisfied when the engine load condition is high. The engine load condition is calculated based on the engine operational conditions detected at the step S20 and various command signals outputted from the output circuit.

At the step S30, it is not always necessary to calculate the engine load condition based on all of the engine operational conditions and all of the command signals. Namely, it may be possible to calculate the engine load condition based on some of the engine operational conditions and some of the command signals. Alternatively, it may be possible to calculate the engine load condition based on the engine operational conditions and a pedal stroke amount of an acceleration pedal.

In the case that the ECU 80 determines at the step S30 that the condition for operating the EGR apparatus 60 is satisfied, the process goes to a step S40. In the case that the condition for operating the EGR apparatus 60 is not satisfied, the process goes back to the step S10.

At the step S40, the ECU 80 estimates an air-intake period, during at least a part of which the EGR gas is supplied into the respective cylinders #1 to #4. The air-intake period is defined as a period from an air-intake starting point to an air-intake ending point. At the air-intake starting point, the operating gas being composed of the intake-air and the injected fuel (and EGR gas, as the case may be) starts to flow into the respective cylinders #1 to #4 through the intake manifold 30 and the respective intake ports 21*a* to 21*d*. At the air-intake ending point, the flow of the operating gas into the cylinders ends.

Figure 4:
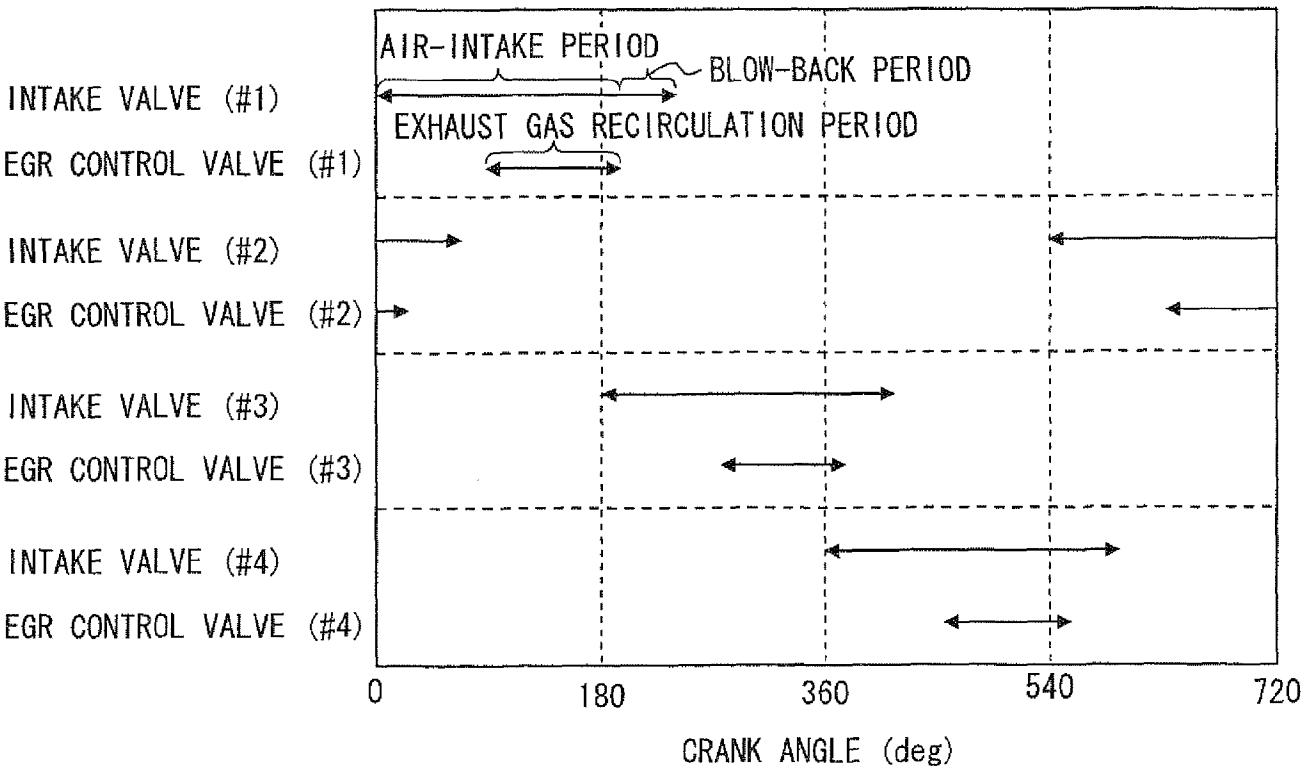
FIG. 4 is a timing chart showing operations of an intake valve and an EGR control valve.

For example, FIG. 4 shows valve opening periods of the respective intake valves 51*a* to 51*d* and valve opening periods of the respective EGR control valves 66*a* to 66*d*. As shown in FIG. 4, during the valve opening period in which the intake valve 51*a* (to 51*d*) is opened, there is not only a blow-in period during which the operating gas flows into the combustion chamber 12*a* (to 12*d*), but also a blow-back period during which a part of the operating gas having flowed into the combustion chamber 12*a* (to 12*d*) may blow back into the intake port 21*a* (to 21*d*).

The blow-back period for the first cylinder 41 will be explained. In FIG. 4, the crank angle of the piston 14 for the first cylinder #1 is indicated as 0 degree, when the piston 14 is at its top dead center. As shown in FIG. 4, a valve closing point of the intake valve 51*a* is at a crank angle over 180 degrees. Namely, when the valve closing point of the intake valve 51*a* is after a bottom dead center of the piston 14, the part of the operating gas having flowed into the combustion chamber 12*a* may blow back into the intake port 21*a*. The blow-back period varies depending on the valve opening and closing points of the intake valve 51*a* and the rotational speed of the crank shaft 16 (that is, the rotational speed of the engine).

For example, the blow-back period becomes shorter as the rotational speed of the engine becomes higher, in the case that the valve closing point of the intake valve 51*a* is after the bottom dead center of the piston 14.

When the engine rotational speed becomes higher, a moving speed of the piston 14 is correspondingly increased, so that flow speed of the operating gas flowing into the combustion chamber 12*a* is likewise increased. As a result, inertia force of the operating gas is also increased. In the compression stroke, in which the piston 14 is moved from its bottom dead center up to its top dead center, the volume of the combustion chamber 12*a* is decreased, so that the blow-back phenomenon may be generated.

The operating gas flowing into the combustion chamber 12*a* (for which the compression stroke has started) has the inertia force, and the inertia force becomes larger as the engine rotational speed is increased. As a result, a timing at which the blow-back phenomenon is generated is delayed because of the larger inertia force of the operating gas. Accordingly, the blow-back period becomes shorter as the engine rotational speed becomes higher, as explained above.

The air-intake period is a period obtained by subtracting the blow-back period from the valve opening period of the intake valve 51*a*.

Figure 5:
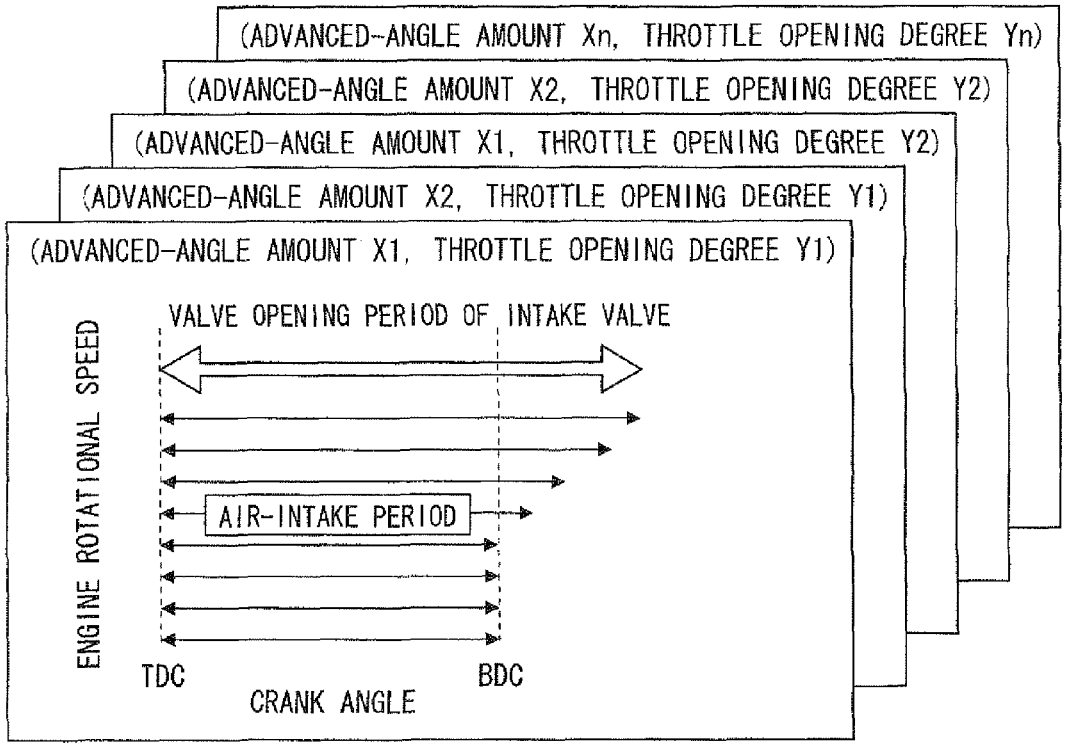
FIG. 5 shows maps for relationships among engine rotational speed, crank angle, and air-intake period, for respective advanced angle amounts and throttle opening degrees, which are used for estimating the air-intake period.

At the step S40, the ECU 80 estimates the air-intake period based on maps memorized in ROM of the ECU 80. As shown in FIG. 5, the maps show relationships among the engine rotational speed, the crank angle, and the air-intake period for the respective advanced-angle amounts (X1, X2, . . . Xn) and throttle opening degrees (Y1, Y2, . . . Yn). The advanced-angle amount is the rotational phase difference of the cam shaft angle with respect to the predetermined crank angle, and indicates how much angle the cam shaft is advanced with respect to the predetermined crank angle. Therefore, the larger the advanced-angle amount is, the more the cam shaft angle is moved to the advancing side relative to the crank angle. As a result, the valve closing point of the intake valve 51*a* (to 51*d*) is advanced by the advanced-angle amount.

The maps for the air-intake periods with respect to the crank angle are prepared for the respective advanced-angle amounts X1 to Xn. This is because the valve closing point of the intake valve 51*a* (to 51*d*) is changed by the valve timing control device 50 and thereby the air-intake periods are correspondingly changed. The advanced-angle amount can be calculated based on the rotational phase difference between the cam shaft angle and the crank angle. The maps are prepared in advance based on experimental results. The ECU 80 estimates the air-intake periods for the respective cylinders #1 to #4 based on the maps. As above, the air-intake periods can be easily estimated without providing specific measuring devices for detecting airflow changes in spaces close to the respective combustion chambers 12*a* to 12*d*.

In the maps for estimating the air-intake periods of the present embodiment, the engine rotational speed is taken into account. In other words, changes of inertial forces for the operating gas which are caused by changes of the engine rotational speed are taken into account. As a result, accuracy for estimating the air-intake periods is improved.

Furthermore, according to the present embodiment, the maps for the air-intake periods with respect to the crank angle are prepared for the respective throttle opening degrees Y1 to Yn. As a result, changes of inertial forces of the intake air, which may be caused by flow amount changes of the intake air flowing through the intake ports 21*a* to 21*d*, are also taken into account. The accuracy for estimating the air-intake periods is improved.

As above, according to the present embodiment, the engine rotational speed as well as the throttle opening degree is taken into account for estimating the air-intake periods. Therefore, the accuracy for estimating the air-intake periods can be further improved compared with the following first and second cases:

In the first case, the air-intake period is estimated based on only the valve opening period of the intake valves 51*a* to 51*d*.

In the second case, the air-intake period is estimated based on a combination of the valve opening period of the intake valves and the engine rotational speed, or a combination of the valve opening period of the intake valves and the throttle opening degree.

In the above embodiment, the invention is explained with reference to the example, in which the valve opening point of the intake valve 51*a* coincides with the crank angle of 0 (zero) degree (that is, the piston 14 is at its top dead center), as shown in FIG. 4. However, the blow-back phenomena of the operating gas may also occur in the case that the valve opening point of the intake valve is before the top dead center of the piston 14, or in the case that the valve opening point of the intake valve is after the top dead center of the piston 14 but the exhaust valve 53*a* is still opened. Accordingly, it may be better to prepare the maps for the air-intake periods, in which the above possible blow-back phenomena are additionally taken into account, to memorize such maps in the memory device, such as ROM, and to estimate the air-intake periods based on such maps.

At a step S50, the ECU 80 calculates and decides an amount of the EGR gas to be re-circulated into the combustion chamber (12*a* to 12*d*) based on the engine load condition. At a step S60, the ECU 80 calculates and decides a valve operating time period and a duty ratio for the EGR control valve (66*a* to 66*d*), based on the information for the air-intake period and the amount of the EGR gas obtained at the steps S40 and S50, so that the calculated amount of the EGR gas is re-circulated during the valve operating time period (which is a part of the air-intake period) of the intake valve (51*a* to 51*d*).

As above, the ECU 80 controls the EGR control valve (66*a* to 66*d*) in accordance with the valve operating time period and duty ratio. Namely, the EGR control valve (66*a* to 66*d*) opens the recirculation passage 61 during the valve operating time period (which is within the air-intake period).

The EGR gas is injected from the injection passage (29*a* to 29*d*) during the valve operating time period, so that the EGR gas flowing into the combustion chamber (12*a* to 12*d*) flows along the inner wall (13*a* to 13*d*) as indicated by arrows shown in FIG. 2 to generate the swirl in each of the combustion chambers (12*a* to 12*d*). Swirling movement is given by the flow of the EGR gas to the intake air as well as the injected fuel (atomized fuel), which flows into the combustion chamber (12*a* to 12*d*) through the intake port (21*a* to 21*d*) together with the EGR gas. Therefore, the intake air as well as the injected fuel also swirls in the respective combustion chambers (12*a* to 12*d*).

As a result that the EGR gas flows along the inner wall (13*a* to 13*d*) of the combustion chamber (12*a* to 12*d*), density of the EGR gas in the vicinity of the center axis C of the combustion chamber (12*a* to 12*d*) becomes lower than the density of the EGR gas adjacent to the inner wall (13*a* to 13*d*). In other words, since the density of the EGR gas in the vicinity of the center axis C, that is in the vicinity of the spark plug (70*a* to 70*d*), becomes lower, ignitionability of air-fuel mixture is improved.

Figure 6:
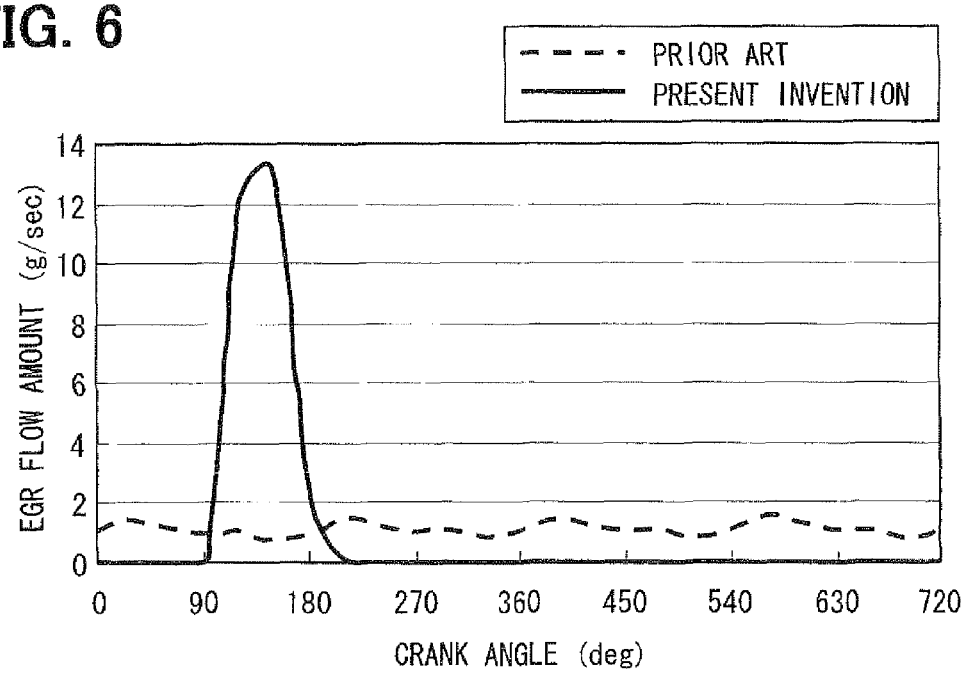
FIG. 6 is a graph showing relationship between crank angle and flow amount of EGR gas.

In addition, according to the present embodiment, the EGR control valve (66*a* to 66*d*) opens the recirculation passage 61, so that the EGR gas is re-circulated into the intake port (21*a* to 21*d*) not during the intake valve (51*a* to 51*d*) is closed but during the intake valve (51*a* to 51*d*) is opened. FIG. 6 shows relationship between crank angle and flow amount of EGR gas. In FIG. 6, a solid line shows an amount of the EGR gas, which is re-circulated during a predetermined period, that is, a period of the crank angle from 90 to 180 degrees in case of the first cylinder #1. The period of the crank angle (90-180 degrees) is a range of the crank angle measured under the condition that the crank angle is set to zero when the piston for the first cylinder #1 is placed at its top dead center. A dotted line in FIG. 6 shows the amount of the EGR gas for a conventional system, wherein the EGR gas is re-circulated into the intake port during the whole period (a period of the crank angle from 0 to 720 degrees). The total amount of the EGR gas re-circulated for the present embodiment and for the conventional system is the same to each other. As seen from FIG. 6, the amount of the EGR gas for the present embodiment, which is injected from the injection passage (29*a* to 29*d*) for unit time, is much larger than that for the conventional system (the dotted line). Therefore, the flow speed of the swirl formed by the EGR gas in the combustion chamber (12*a* to 12*d*) becomes higher. Namely, the swirl flow becomes stronger. As a result, combustion of the air-fuel mixture is facilitated to shorten combustion period and to realize such combustion having high combustion efficiency.

As above, the ignitionability of the air-fuel mixture is improved by the EGR apparatus 60 of the present invention, to thereby facilitate the combustion.

The longer the EGR gas stays in the intake port (21*a* to 21*d*), the more homogeneous the EGR gas will be mixed up with the air-fuel mixture. In the case that the swirl is generated in the combustion chamber (12*a* to 12*d*) after the EGR gas is homogeneously mixed with the air-fuel mixture, the density of the EGR gas (stratified layer of the EGR gas in the mixture) in the vicinity of the spark plug (70*a* to 70*d*) becomes higher.

According to the present embodiment, the period during which the EGR gas is injected from the injection passage (29*a* to 29*d*), that is the valve operating time period for the EGR control valve (66*a* to 66*d*), is within the period during which the intake valve (51*a* to 51*d*) is opened, and more specifically, within the air-intake period. In other words, the EGR gas is not injected during a period other than the air-intake period. Therefore, the EGR gas may not be re-circulated during the blow-back period. The EGR gas may not stay in the intake port (21*a* to 21*d*) and surely re-circulated into the combustion chamber (12*a* to 12*d*), so that it is possible to keep the density of the EGR gas in the vicinity of the spark plug (70*a* to 70*d*) at a lower value.

Since the density of the EGR gas in the vicinity of the spark plug (70*a* to 70*d*) is kept at the lower value by the EGR apparatus 60, more EGR gas can be re-circulated into the combustion chamber (12*a* to 12*d*), without decreasing the ignitionability for the air-fuel mixture. As a result, an absolute amount of the operating gas can be increased to improve thermal efficiency of the engine 1.

According to the EGR apparatus of the present embodiment, it is possible to re-circulate more EGR gas into the combustion chamber (12*a*-12*d*), so that the pressure in the intake port (21*a*-21*d*) is increased. Such increase tends to prevent the intake air from flowing into the combustion chamber (12*a*-12*d*). Then, the ECU 80 controls the throttle valve 91 in such a manner to make the opening degree thereof larger, in order to achieve necessary intake air amount corresponding to the target torque. As a result, pumping loss of the engine 1 can be decreased. As above, when the EGR apparatus 60 is applied to the engine 1, mechanical loss can be decreased to thereby increase mechanical efficiency of the engine 1.

Furthermore, according to the present embodiment, the recirculation of the EGR gas into the intake port (21*a*-21*d*) is operated by the EGR control valve (66*a*-66*d*), electrical power supply to which is controlled by the ECU 80. It is possible to easily re-circulate the EGR gas into the intake port (21*a*-21*d*) at most appropriate timing. In addition, it is further possible to freely change a recirculation period (that is, the valve operating time period for the EGR control valve) within the air-intake period. Furthermore, it is possible to freely change the recirculation amount of the EGR gas for the unit time by means of changing the duty ratio for the EGR control valve. As a result, it is possible to freely change strength of the swirl flow.

(Modification of First Embodiment)

Figure 7:
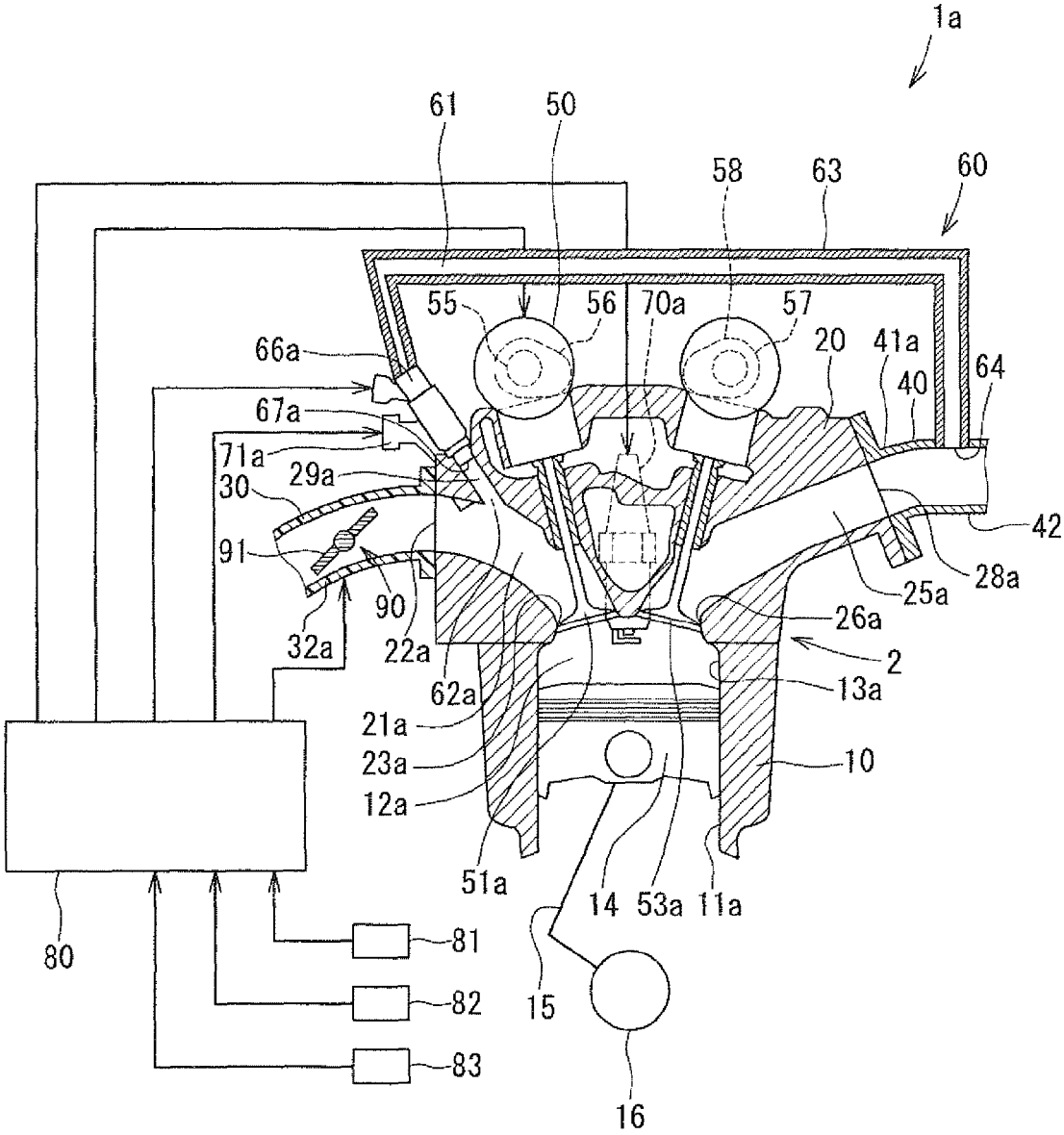
FIG. 7 is a cross-sectional view schematically showing a structure of an engine, to which the EGR apparatus according to the first embodiment of the present invention is applied, wherein an air-flow control device is not provided in the engine.

According to a modification of the above first embodiment, the EGR apparatus 60 of the first embodiment is applied to an engine 1*a*, which does not have any portion corresponding to the air-flow control devices 92. FIG. 7 is a schematic view showing a structure of the engine 1*a*, to which the EGR apparatus 60 according to the first embodiment of the present invention is applied. The engine 1*a* is also an in-line type four-cylinder gasoline engine. According to the engine 1*a*, throttle valve devices 90 are provided in the respective bifurcating portions 32*a* to 32*d* communicated to the first to fourth cylinders #1 to #4. FIG. 7 shows only the first cylinder #1.

According to the modification, the ECU 80 carries out the process of FIG. 3 to estimate the air-intake period based on the maps, so that the valve body of the EGR control valve (66*a*-66*d*) is opened and closed during the estimated air-intake period. According to the modification, therefore, the swirl flow in the combustion chamber (12*a*-12*d*) likewise becomes stronger. And ignitionability for the air-fuel mixture is improved to facilitate the combustion thereof.

Second Embodiment

An EGR apparatus 601 according to a second embodiment is a modification of the EGR apparatus 60 of the first embodiment. The EGR apparatus 601 is applied to the engine 1, which has the throttle valve device 90 and the air-flow control devices 92 each provided in the intake manifold 30, as in the same manner to the first embodiment. The second embodiment (the EGR apparatus 601) is different from the first embodiment (the EGR apparatus 60), in a method for estimating the air-intake period. According to the second embodiment (the EGR apparatus 601), the ECU 80 estimates the air-intake period based on a pressure difference between pressures at an upstream side and a downstream side of the air-flow control valve (93*a*-93*d*) of the air-flow control device 92.

Figure 8:
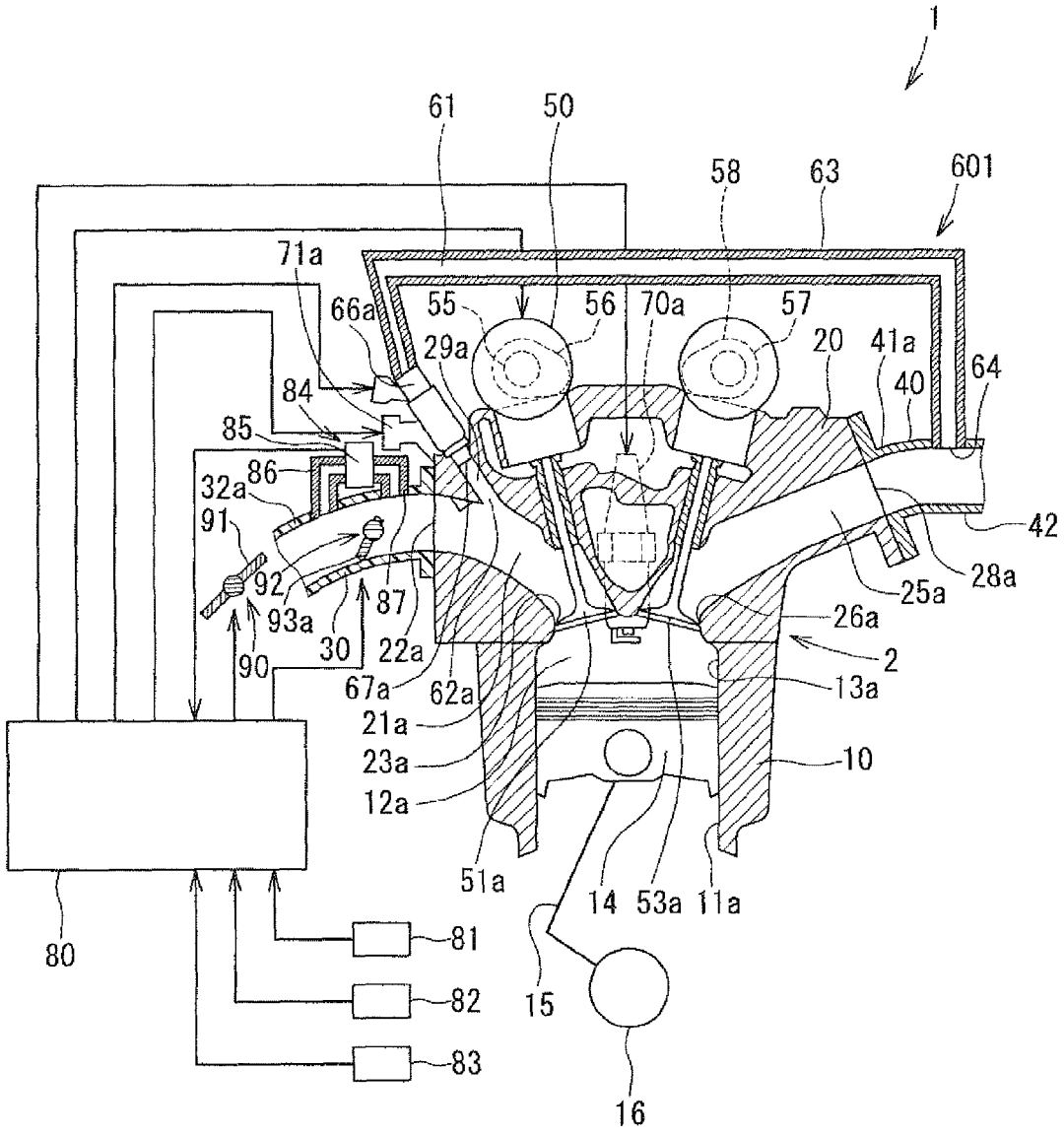
FIG. 8 is a cross-sectional view schematically showing a structure of an engine, to which an EGR apparatus according to a second embodiment of the present invention is applied.

FIG. 8 is a schematic view showing the structure of the engine 1, to which the EGR apparatus 601 according to the second embodiment is applied. The engine 1 is also the in-line type four-cylinder gasoline engine. FIG. 8 shows only the first cylinder #1. Since structures for the second to fourth cylinders are substantially the same to the first cylinder, explanation thereof is omitted.

A differential pressure sensor 84 is provided at the bifurcating portion 32*a* of the intake manifold 30 for detecting differential pressure between pressures at an upstream side and a downstream side of the air-flow control valve 93*a*. The differential pressure sensor 84 is provided for each of the bifurcating portions 32*a* to 32*d*. When the air-flow control valve (93*a*-93*d*) closes a part of the flow passage formed by the bifurcating portion (32*a*-32*d*), the differential pressure is generated between the upstream side and the downstream side of the air-flow control valve (93*a*-93*d*) during a period in which the intake air flows into the combustion chamber (12*a*-12*d*). The differential pressure sensor 84 is also referred to as a differential pressure detecting device.

The differential pressure sensor 84 is composed of a sensing portion 85, a first pressure introducing portion 86 for introducing the pressure at the upstream side of the air-flow control valve 93*a* to the sensing portion 85, a second pressure introducing portion 87 for introducing the pressure at the downstream side of the air-flow control valve 93*a* to the sensing portion 85, and so on.

The sensing portion 85 is formed by a deformable member of a plate-shape, a strain gauge formed on the deformable member, and so on. The pressure at the upstream side of the air-flow control valve 93*a* is applied to one side surface of the deformable member through the first pressure introducing portion 86, while the pressure at the downstream side of the air-flow control valve 93*a* is applied to the other side surface of the deformable member through the second pressure introducing portion 87. The deformable member is bent depending on a degree of the differential pressure. When the deformable member is bent, the strain gauge is correspondingly bent so as to generate a signal depending on a bent amount (that is, the differential pressure).

The ECU 80 estimates the air-intake period based on the detected result of the differential pressure sensor 84, so that the valve body of the EGR control valve (66*a*-66*d*) is opened and closed during the estimated air-intake period. According to the second embodiment, the swirl flow in the combustion chamber (12*a*-12*d*) likewise becomes stronger. And ignitionability for the air-fuel mixture is improved to facilitate the combustion thereof.

According to the present embodiment, the differential pressure sensor 84 detects the differential pressure, which is generated between the upstream side and the downstream side of the air-flow control valve 93*a*, which is always generated during the air-intake period, and the ECU 80 estimates the air-intake period based on the detected result of the differential pressure sensor 84. Therefore, the estimation accuracy for the air-intake period is improved.

The differential pressure sensor is not limited to the type above explained. For example, such type of the sensor, according to which the differential pressure is detected based on changes of electrostatic capacity between a pair of electrodes, may be used. Alternatively, pressure sensors are provided at the upstream and downstream sides of the air flow control valve, so that differential pressure may be calculated from outputs of both of the pressure sensors.

(Modification of Second Embodiment)

Figure 9:
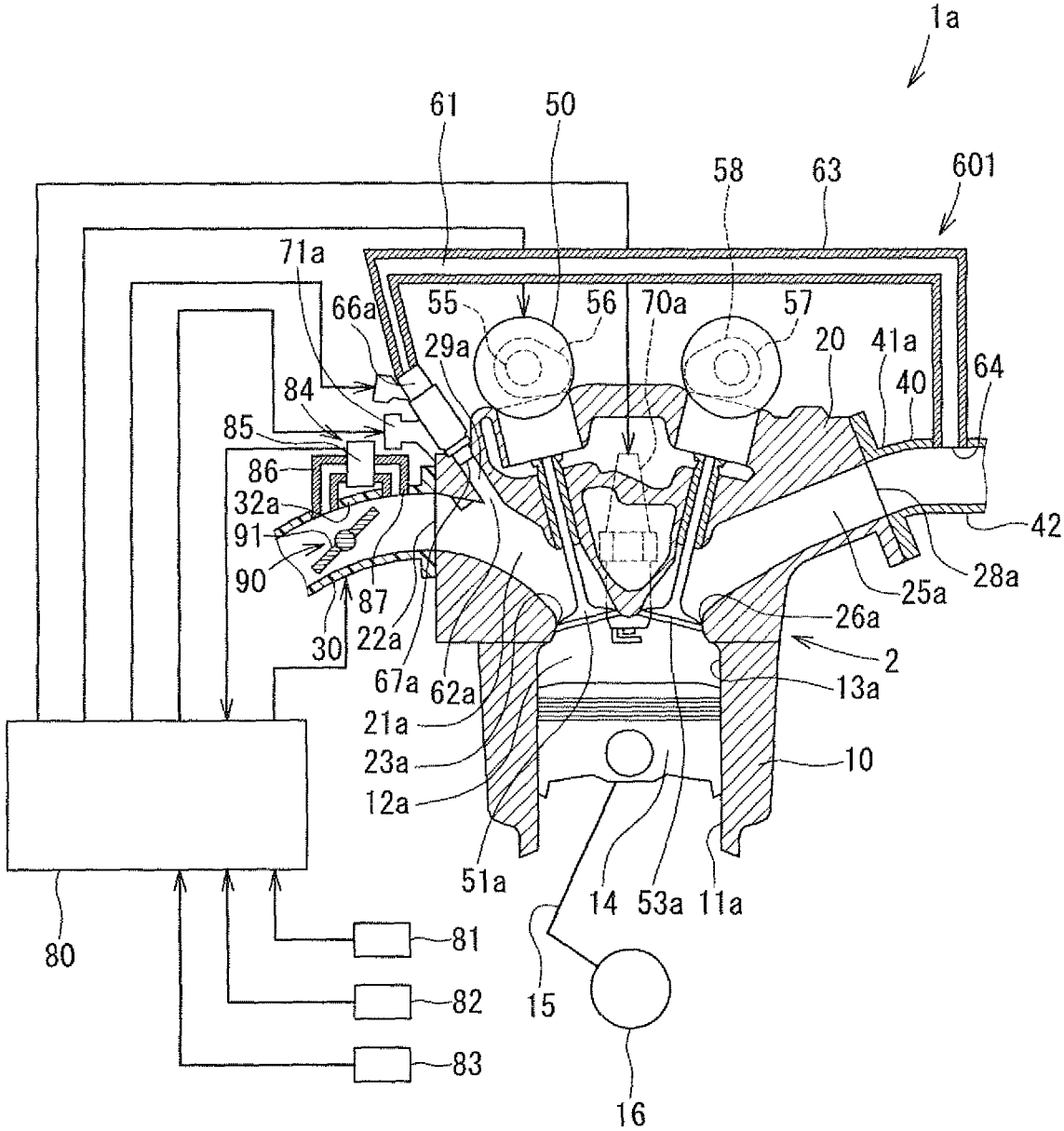
FIG. 9 is a cross-sectional view schematically showing a structure of an engine, to which the EGR apparatus according to the second embodiment of the present invention is applied, wherein the air-flow control device is not provided in the engine.

According to a modification of the above second embodiment, the EGR apparatus 601 of the second embodiment is applied to an engine 1*a*, which does not have any portion corresponding to the air-flow control devices 92. FIG. 9 is a schematic view showing a structure of the engine 1*a*, to which the EGR apparatus 601 according to the second embodiment of the present invention is applied. The engine 1*a* is also an in-line type four-cylinder gasoline engine. According to the engine 1*a*, throttle valve devices 90 are provided in the respective bifurcating portions 32*a* to 32*d* communicated to the first to fourth cylinders #1 to #4. FIG. 9 shows only the first cylinder #1. Hereinafter, an explanation will be made only to the first cylinder #1. Since structures for the second to fourth cylinders #2 to #4 are substantially the same to the first cylinder #1, explanation thereof is omitted.

The differential pressure sensor 84 is provided at the bifurcating portion 32*a* of the intake manifold 30 for detecting differential pressure between pressures at an upstream side and a downstream side of the throttle valve 91. The differential pressure sensor 84 is provided for each of the bifurcating portions 32*a* to 32*d*. When the throttle valve 91 is driven to rotate so that the throttle valve device 90 controls intake air amount to be supplied into the combustion chamber (12*a*-12*d*), the differential pressure is generated between the upstream side and the downstream side of the throttle valve 91 during a period in which the intake air flows into the combustion chamber (12*a*-12*d*). The differential pressure sensor 84 of the modification is the same to that of the second embodiment.

The ECU 80 estimates the air-intake period based on the detected result of the differential pressure sensor 84, so that the valve body of the EGR control valve (66*a*-66*d*) is opened and closed during the estimated air-intake period. According to the modification of the second embodiment, the swirl flow in the combustion chamber (12*a*-12*d*) likewise becomes stronger. And ignitionability for the air-fuel mixture is improved to facilitate the combustion thereof.

Third Embodiment

An EGR apparatus 602 according to a third embodiment is a modification of the EGR apparatuses 60 and 601 of the first and second embodiments. The EGR apparatus 602 is applied to the engine 1, which has the throttle valve device 90 and the air-flow control devices 92 each provided in the intake manifold 30, as in the same manner to the first and second embodiments. The EGR apparatus 602 has EGR control valves 661*a* (to 661*d*) respectively connected to the injection passages 29*a* to 29*d*. Each of the EGR control valves 661*a* (to 661*d*) has a valve member 110 for opening and closing the recirculation passage 61 depending on and by means of differential pressure, which is generated between an upstream side and a downstream side of the air-flow control valve 93*a* of the air-flow control device 92.

Figure 10:
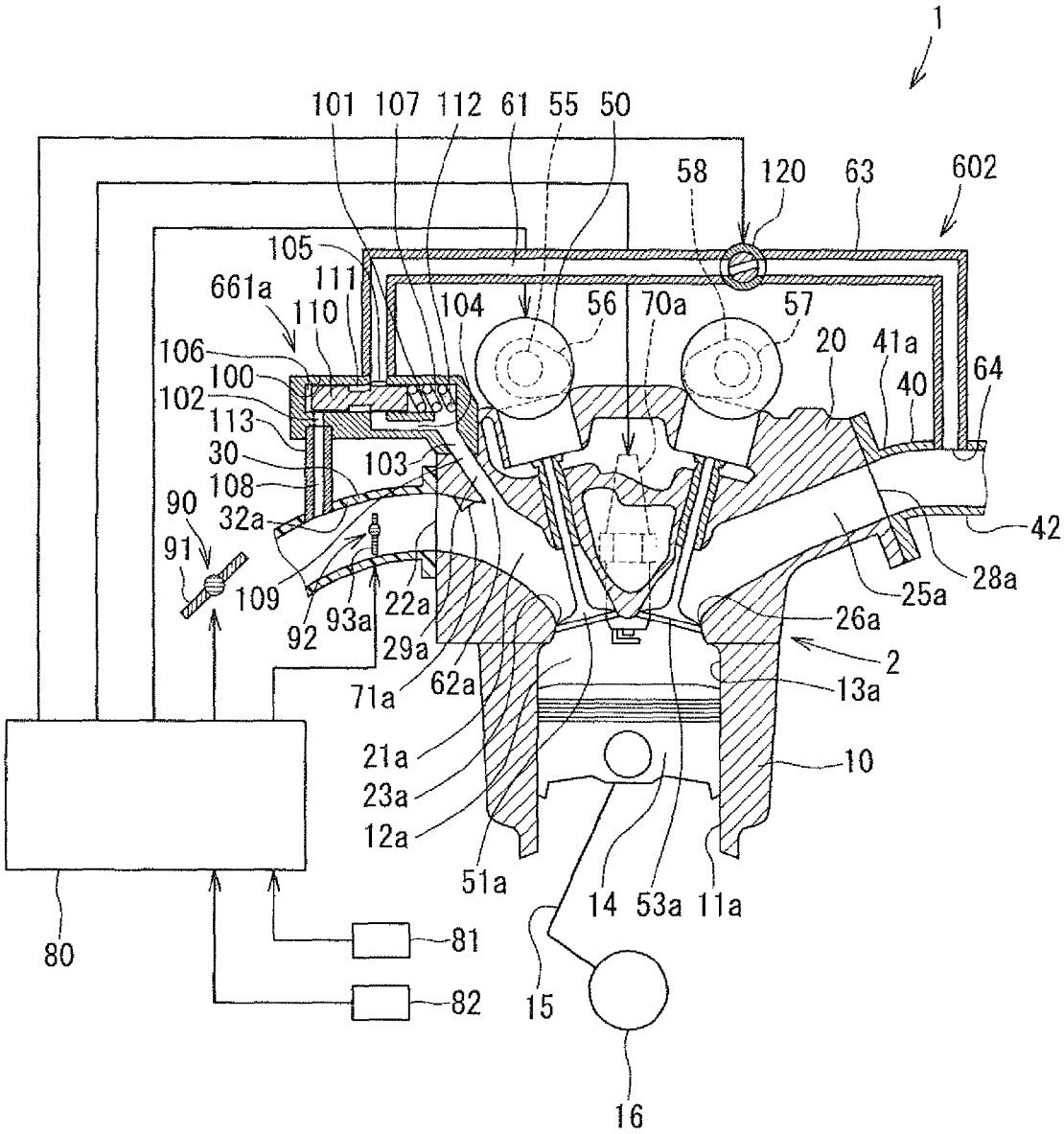
FIG. 10 is a cross-sectional view schematically showing a structure of an engine, to which an EGR apparatus according to a third embodiment of the present invention is applied.

FIG. 10 is a schematic view showing the structure of the engine 1, to which the EGR apparatus 602 according to the third embodiment is applied. The engine 1 is also the in-line type four-cylinder gasoline engine. FIG. 10 shows only the first cylinder #1. Since structures for the second to fourth cylinders #2 to #4 are substantially the same to the first cylinder #1, explanation thereof is omitted.

The EGR control valve 661*a* is composed of the valve member 110, a housing body 100 having an accommodating portion 101 for accommodating the valve member 110 which is movable in a reciprocating manner, an upstream-side-pressure introducing portion 108 for introducing pressure at an upstream side of the air-flow control valve 93*a* to the accommodating portion 101, a downstream-side-pressure introducing portion 109 for introducing pressure at a downstream side of the air-flow control valve 93*a* to the accommodating portion 101, and so on.

The valve member 110 is formed in a cylindrical shape, and the accommodating portion 101 accommodates the valve member 110 so that it may be moved in an axial direction thereof. An annular groove 111 is formed at an intermediate outer peripheral portion of the valve member 110.

A length of the accommodating portion 101 in its axial direction is larger than that of the valve member 110, so that the accommodating portion 101 is divided into a first pressure chamber 106 and a second pressure chamber 107 when the valve member 110 is accommodated in the accommodating portion 101. In FIG. 10, the first pressure chamber 106 is formed on a left-hand side of the valve member 110, while the second pressure chamber 107 is formed on a right-hand side of the valve member 110.

In addition to the accommodating portion 101, the housing body 100 further has a passageway 102 for connecting the first pressure chamber 106 with a pipe member 113 communicated to the upstream side of the air-flow control valve 93*a*, a passageway 103 for connecting the second pressure chamber 107 with the injection passage 29*a*, an opening portion 105 connected to the EGR pipe 63, and a passageway 104 for connecting the opening portion 105 with the passageway 103 via the annular groove 111 when the valve member 110 is axially moved to a position at which the annular groove 111 is brought into communication with the opening portion 105.

The upstream-side-pressure introducing portion 108 is formed by the pipe member 113 and the passageway 102, while the downstream-side-pressure introducing portion 109 is formed by the injection passage 29*a* and the passageway 103.

When the valve member 110 is moved toward the first pressure chamber 106, communication between the opening portion 105 and the passageway 104 is shut down by an outer peripheral portion of the valve member 110 which is formed on a right-hand side of the annular groove 111. When the valve member 110 is moved toward the second pressure chamber 107, the passageway 104 is brought into the communication with the opening portion 105.

When the valve member 110 shuts down the communication between the opening portion 105 and the passageway 104, the pressure at the upstream side of the air-flow control valve 93*a* is introduced into the first pressure chamber 106 via the pipe member 113 and the passageway 102, while the pressure at the downstream side of the air-flow control valve 93*a* is introduced into the second pressure chamber 107 via the injection passage 29*a* and the passageway 103.

A spring 112 is arranged in the second pressure chamber 107 so as to bias the valve member 110 toward the first pressure chamber 106.

According to the EGR control valve 661*a*, a thrust power is generated at the valve member 110 to push the same in the direction toward the second pressure chamber 107 (or toward the first pressure chamber 106), when the differential pressure is produced between the pressures in the first and second pressure chambers 106 and 107.

When the pressure in the second pressure chamber 107 is lower than that in the first pressure chamber 106, the thrust power toward the second pressure chamber 107 is generated at the valve member 110. When the pressure in the second pressure chamber 107 is higher than that in the first pressure chamber 106, the thrust power toward the first pressure chamber 106 is generated at the valve member 110. The thrust power depends on the differential pressure between the first and second pressure chambers 106 and 107.

When the pressure in the first pressure chamber 106 is higher than that in the second pressure chamber 107, and the differential pressure is larger than a first predetermined value, namely when the thrust power toward the second pressure chamber 107 becomes larger than the biasing force of the spring 112, the valve member 110 is axially moved in the direction to the second pressure chamber 107. When the annular groove 111 of the valve member 110 is brought into communication with the opening portion 105, the passageway 104 is brought into communication with the opening portion 105.

On the other hand, when the differential pressure becomes lower than a second predetermined value, which is smaller than the first predetermined value, namely when the thrust power toward the second pressure chamber 107 becomes smaller than the biasing force of the spring 112, the valve member 110 is axially moved in the direction to the first pressure chamber 106. As a result, the communication between the opening portion 105 and the passageway 104 is shut down by the outer peripheral portion of the valve member 110 which is formed on the right-hand side of the annular groove 111.

The passageway 102 and the pipe member 113 are also referred to as the first pressure introducing portion, and the passageway 103 and the injection passage 29*a* are also referred to as the second pressure introducing portion, wherein the second pressure introducing portion forms a part of the recirculation passage.

A flow-amount control valve 120 is provided in the EGR pipe 63 so as to control flow-amount of the EGR gas flowing through the EGR pipe 63. The flow-amount control valve 120 is operated by the ECU 80.

The opening portion 105, the passageway 104, the annular groove 111, and the EGR pipe 63 are so designed that they allow the flow of the EGR gas even when the flow-amount control valve 120 is operated to its fully-opened position, so that maximum amount of the EGR gas can be re-circulated through the recirculation passage 61.

An operation of the EGR apparatus 602 of the present embodiment will be explained with reference to FIGS. 10 and 11. An operation for the first cylinder #1 will be explained. Since operations for the second to fourth cylinders #2 to 44 are substantially the same to that of the first cylinder #1, the explanation thereof is omitted.

When the intake valve 51*a* for the first cylinder #1 is opened during a condition in which the air-flow control valve 93*a* of the air-flow control device 92 closes a part of the air-intake passage (the intake valve 51*a* starts opening at the crank angle of 0 (zero) degree), the differential pressure is generated between the upstream side and the downstream side of the air-flow control valve 93*a*.

As a result that the differential pressure is generated at the air-flow control valve 93*a*, the differential pressure between the first and second pressure chambers 106 and 107 is correspondingly generated. When the differential pressure becomes larger than the first predetermined value, the valve member 110 is moved toward the second pressure chamber 107.

When the annular groove 111 is brought into communication with the opening portion 105 as a result of the movement of the valve member 110, the EGR gas in the EGR pipe 63 is introduced into the injection passage 29*a*, so that the EGR gas is injected from the injection passage 29*a* to the intake port. According to the present embodiment, the amount of the EGR gas injected from the injection passage 29*a* is controlled by the flow-amount control valve 120.

Figure 11:
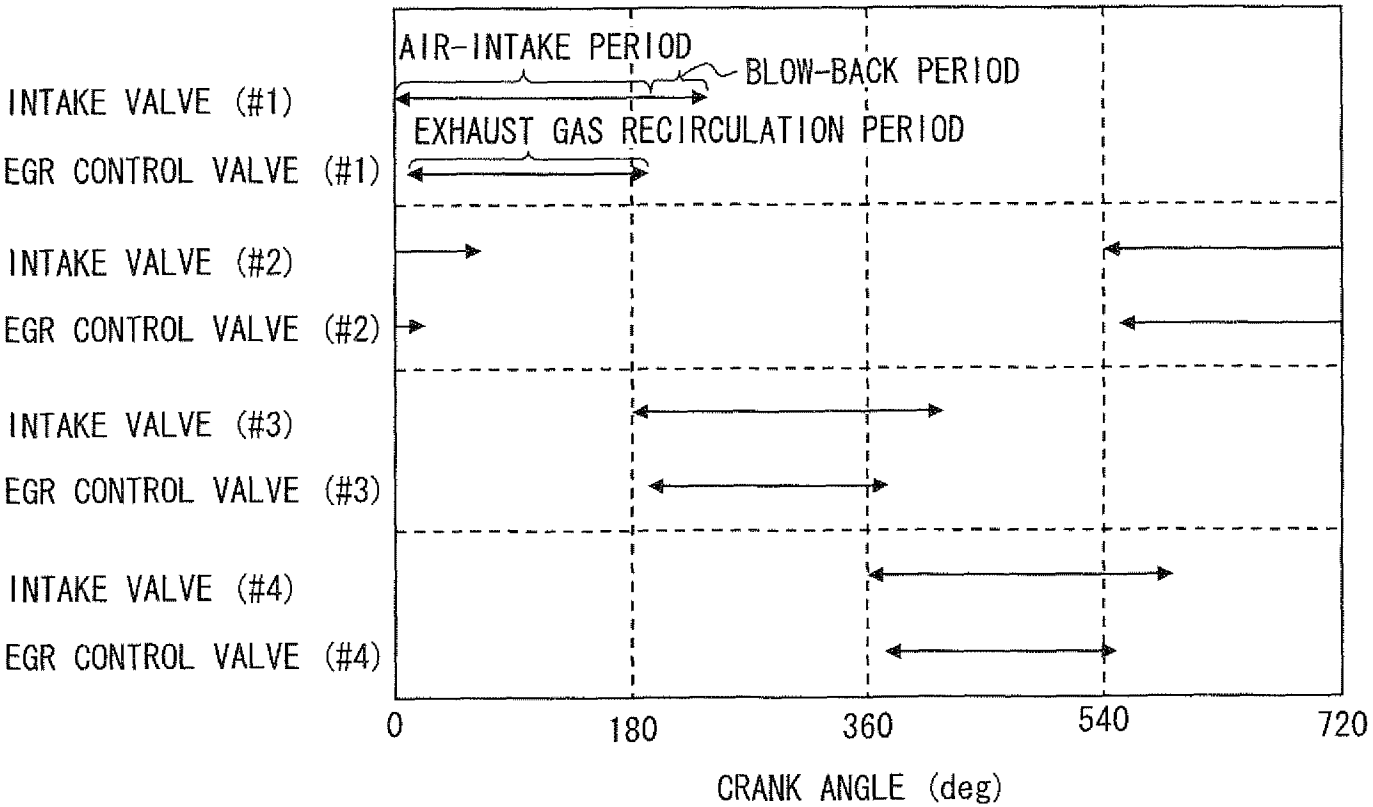
FIG. 11 is a timing chart showing operations of an intake valve and an EGR control valve according to the above third embodiment.

The blow-back phenomena may occur depending on a position of the piston 14 during a period in which the intake valve 51*a* is opened, as shown in FIG. 11. When the blow-back occurs, the differential pressure at the air-flow control valve 93*a* becomes smaller. The differential pressure between the first and second pressure chambers 106 and 197 is correspondingly decreased.

When the differential pressure becomes smaller than the second predetermined value, the valve member 110 is moved toward the first pressure chamber 106. As a result, the communication between the opening portion 105 and the passageway 104 is shut down by the outer peripheral portion of the valve member 110, so that the injection of the EGR gas from the injection passage 29*a* is stopped. In other words, the EGR control valve 661*a* is automatically closed depending on the decrease of the differential pressure, when the blow-back occurs, as shown in FIG. 11.

As above, according to the EGR apparatus 602 of the third embodiment, the EGR gas is only allowed to flow into the combustion chamber during the air-intake period, so that the same effect to the first embodiment can be obtained.

According to the third embodiment, it is not necessary for the ECU 80 to estimate the air-intake period and to electrically operate the EGR control valve 661*a*. Namely, according to the third embodiment, the EGR control valve 661*a* is automatically operated by the differential pressure, which is generated between the upstream and downstream sides of the air-flow control valve 93*a*, so that the EGR control valve 661*a* is opened only during the air-intake period so as to re-circulate the EGR gas into the combustion chamber 12*a*. Accordingly, it is not necessary in the third embodiment to provide an electrical driving device for operating the EGR control valve 661*a* and various kinds of sensors for estimating the air-intake period. The structure of the EGR apparatus 602 becomes simpler.

(Modification of Third Embodiment)

Figure 12:
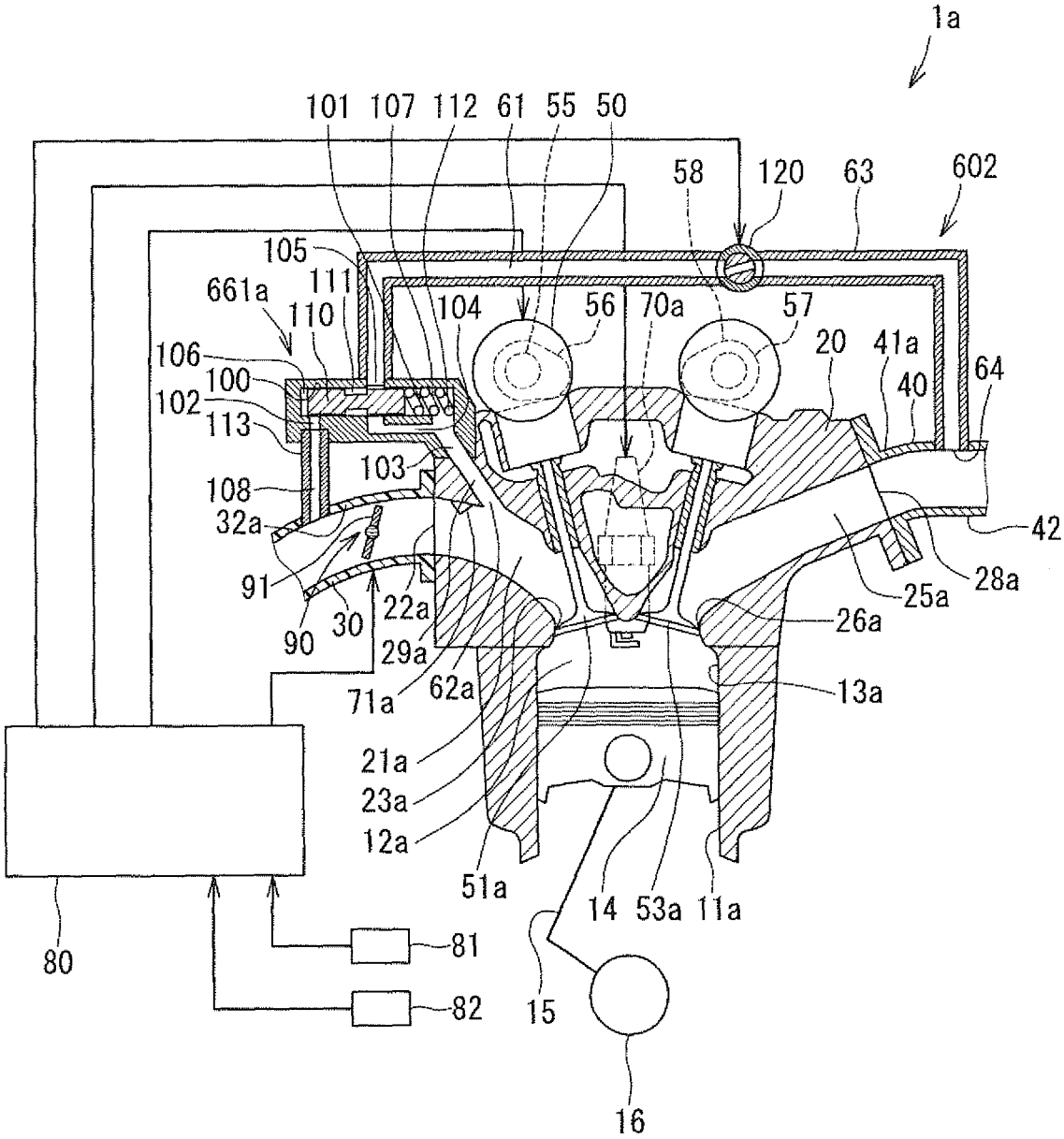
FIG. 12 is a cross-sectional view schematically showing a structure of an engine, to which the EGR apparatus according to the third embodiment of the present invention is applied, wherein the air-flow control device is not provided in the engine.

According to a modification of the third embodiment, the EGR apparatus 602 of the third embodiment is applied to an engine 1*a*, which does not have any portion corresponding to the air-flow control devices 92. FIG. 12 is a schematic view showing a structure of the engine 1*a*, to which the EGR apparatus 602 according to the third embodiment of the present invention is applied. The engine 1*a* is also the in-line type four-cylinder gasoline engine. According to the engine 1*a*, throttle valve devices 90 are provided in the respective bifurcating portions 32*a* to 32*d* communicated to the first to fourth cylinders #1 to #4. FIG. 12 shows only the first cylinder #1. Hereinafter, an explanation will be made only to the first cylinder #1. Since structures for the second to fourth cylinders #2 to #4 are substantially the same to the first cylinder #1, explanation thereof is omitted.

The EGR control valve 661*a* is provided at the bifurcating portion 32*a* of the intake manifold 30 in order that differential pressure generated at the upstream and downstream sides of the throttle valve 91 is introduced to the EGR control valve 661*a*. The pipe member 113 is connected to the passageway 102 of the EGR control valve 661*a*, and the injection passage 29*a* is connected to the passageway 103.

The valve member 110 of the EGR control valve 661*a* opens the recirculation passage 61 during the air-intake period, depending on and by means of differential pressure, which is generated between an upstream side and a downstream side of the throttle valve 91 when the throttle valve 91 is rotated to control flow amount of the intake air into the combustion chamber 12*a*.

According to the modification of the third embodiment, the EGR gas can be automatically re-circulated into the combustion chamber 12*a* only during the air-intake period, by use of the differential pressure generated at the upstream and the downstream sides of the throttle valve 91.

What is claimed is:

1. An exhaust gas recirculation system for an internal combustion engine having multiple cylinders comprising:

a recirculation pipe unit having a gas inlet port connected to an exhaust gas passage of the engine, the recirculation pipe unit further having multiple branched-off pipe portions, each one end of the branched-off pipe portions being communicated to the gas inlet port and each other end of the branched-off pipe portions being respectively connected to each injection port opening to each of intake ports of the engine, so that exhaust gas injected into the respective intake ports flows into respective combustion chambers and flows along an inner wall of the corresponding combustion chamber so as to form swirl flow therein; and multiple EGR control devices respectively provided in each of the branched-off pipe portions, wherein each of the EGR control devices opens each of the corresponding branched-off pipe portions during an exhaust gas recirculation period which is a part of a valve-opening period of a corresponding intake valve, so that the exhaust gas is re-circulated from the exhaust gas passage into the respective combustion chambers for which the corresponding intake valve is opened, and each of the EGR control devices closes the corresponding branched-off pipe portions at least during a valve-closing period of the corresponding intake valve in each combustion cycle in which the exhaust gas is re-circulated.

2. The exhaust gas recirculation system according to the claim 1, wherein the exhaust gas recirculation period is a part of an air-intake period starting from a point at which flow-in of intake air to the combustion chamber starts and ending at a point at which the flow-in of the intake air to the combustion chamber ends, and the EGR control devices closes the corresponding branched-off pipe portion at least during a period other than the air-intake period.

3. The exhaust gas recirculation system according to the claim 1, wherein the EGR control devices opens the corresponding branched-off pipe portion only during the exhaust gas recirculation period, so that the corresponding branched-off pipe portion is closed during a period other than the exhaust gas recirculation period.

4. The exhaust gas recirculation system according to the claim 1, wherein a blow-back period is not included in the exhaust gas recirculation period, so that the branched-off pipe portion is closed by the corresponding EGR control device during the blow-back period.

5. The exhaust gas recirculation system according to the claim 1, wherein each of the EGR control devices is composed of an electromagnetic valve operated with electrical power supply, and wherein the exhaust gas recirculation system further comprises an electronic control unit for controlling opening and closing operation of the electromagnetic valve.

6. The exhaust gas recirculation system according to the claim 5, wherein the electronic control unit comprises:

a valve-opening period detecting portion for detecting the valve-opening period of the corresponding intake valve; and an estimating portion for estimating the air-intake period based on the valve-opening period, wherein the electronic control unit controls the opening and closing operation of the electromagnetic valve based on such estimated air-intake period.

7. The exhaust gas recirculation system according to the claim 5, wherein the electronic control unit comprises:

a valve-opening period detecting portion for detecting the valve-opening period of the corresponding intake valve;

a rotational speed detecting portion for detecting rotational speed of a crank shaft of the engine; and an estimating portion for estimating the air-intake period based on the valve-opening period and the rotational speed of the crank shaft, wherein the electronic control unit controls the opening and closing operation of the electromagnetic valve based on such estimated air-intake period.

8. The exhaust gas recirculation system according to the claim 5, wherein the electronic control unit comprises:

a valve-opening period detecting portion for detecting the valve-opening period of the corresponding intake valve;

a throttle opening detecting portion for detecting throttle opening degree of a throttle valve of the engine; and an estimating portion for estimating the air-intake period based on the valve-opening period and the throttle opening degree of the throttle valve, wherein the electronic control unit controls the opening and closing operation of the electromagnetic valve based on such estimated air-intake period.

9. The exhaust gas recirculation system according to the claim 5, wherein the electronic control unit comprises:

a valve-opening period detecting portion for detecting the valve-opening period of the corresponding intake valve;

a rotational speed detecting portion for detecting rotational speed of a crank shaft of the engine;

a throttle opening detecting portion for detecting throttle opening degree of a throttle valve of the engine; and an estimating portion for estimating the air-intake period based on the valve-opening period, the rotational speed of the crank shaft, and the throttle opening degree of the throttle valve, wherein the electronic control unit controls the opening and closing operation of the electromagnetic valve based on such estimated air-intake period.

10. The exhaust gas recirculation system according to the claim 6, wherein the valve-opening period detecting portion detects the valve-opening period of the corresponding intake valve, based on rotational phase difference between a crank angle of a crank shaft and a cam shaft angle of a cam shaft of the engine.

11. The exhaust gas recirculation system according to the claim 1, further comprising:

a differential pressure detecting device for detecting differential pressure, which is a difference between pressure at an upstream side and a downstream side of an air control valve provided in each of intake air passages of the engine respectively connected to the intake ports, wherein the air control valve is composed of a throttle valve for controlling amount of intake air to be supplied into the combustion chamber, or composed of an air-flow control valve for controlling air-flow of the intake air to be supplied into the combustion chamber; and an electronic control unit having an estimating portion for estimating the air-intake period based on the differential pressure, wherein the electronic control unit controls the opening and closing operation of the EGR control devices based on such estimated air-intake period.

12. The exhaust gas recirculation system according to the claim 5, wherein each of the electromagnetic valves of the EGR control devices is operated by ON-OFF control of the electric power supply, and a duty ratio of the ON-OFF control is controlled by the electronic control unit.

13. The exhaust gas recirculation system according to the claim 1, wherein each of the EGR control devices is a mechanically operated valve device, which opens and closes the corresponding branched-off pipe portion in accordance with differential pressure, which is a difference between pressure at an upstream side and a downstream side of an air control valve provided in each of intake air passages of the engine respectively connected to the intake ports, and the air control valve is composed of a throttle valve for controlling amount of intake air to be supplied into the combustion chamber, or composed of an air-flow control valve for controlling air-flow of the intake air to be supplied into the combustion chamber.

14. The exhaust gas recirculation system according to the claim 13, wherein the mechanically operated valve device comprises;

a housing body having an accommodating portion for movably accommodating a valve member; and first and second pressure chambers formed in the housing body at opposite sides of the valve member, wherein the first pressure chamber is connected to an upstream side of the air control valve so that the pressure in the branched-off pipe portion at the upstream side of the air control valve is introduced into the first pressure chamber, and wherein the second pressure chamber is connected to a downstream side of the air control valve so that the pressure in the branched-off pipe portion at the downstream side of the air control valve is introduced into the second pressure chamber.

15. The exhaust gas recirculation system according to the claim 13, further comprising:

a flow-amount control valve is provided in the recirculation pipe unit so as to control flow-amount of the exhaust gas to be re-circulated through the recirculation pipe unit.

* * * * *